United States Patent [19]

Theurer et al.

[11] Patent Number: 4,884,509

[45] Date of Patent: Dec. 5, 1989

[54] MOBILE TIE GANG APPARATUS

[75] Inventors: Josef Theurer, Vienna; Johann Hansmann, Klosterneuburg; Friedrich Oellerer, Linz, all of Austria

[73] Assignee: Franz Plasser Bannbaumaschinen-Industriegesellschaft m.b.H., Vienna, Austria

[21] Appl. No.: 302,058

[22] Filed: Jan. 25, 1989

Related U.S. Application Data

[63] Continuation of Ser. No. 97,757, Sep. 17, 1987, abandoned.

[30] Foreign Application Priority Data

Oct. 13, 1986 [AT] Austria ..... 2720/86
Feb. 6, 1987 [AT] Austria ..... 247/87

[51] Int. Cl.[4] ..... E01B 29/10

[52] U.S. Cl. ..... 104/9; 104/12; 414/339

[58] Field of Search ..... 104/2, 9, 16, 12; 414/339

[56] References Cited

U.S. PATENT DOCUMENTS

| | | | |
|---|---|---|---|
| 3,314,374 | 4/1967 | Moorehead et al. | 104/9 |
| 3,964,397 | 6/1976 | Dieringer et al. | 104/9 |
| 4,049,136 | 9/1977 | Fleenor | 414/339 |
| 4,096,954 | 6/1978 | Buckner . | |
| 4,099,635 | 7/1978 | Leonard et al. | 414/339 X |
| 4,175,902 | 11/1979 | Herzog et al. . | |
| 4,178,123 | 12/1979 | Loeffler | 414/339 X |
| 4,190,394 | 2/1980 | Herzog et al. . | |
| 4,253,398 | 3/1981 | Theurer et al. . | |
| 4,502,389 | 3/1985 | Theurer et al. | 104/2 |
| 4,534,295 | 8/1985 | Theurer . | |
| 4,669,387 | 6/1987 | Coasarini et al. | 104/2 X |
| 4,733,614 | 3/1988 | Mohr et al. | 104/12 |

FOREIGN PATENT DOCUMENTS

| | | | |
|---|---|---|---|
| 91209 | 8/1978 | Japan . | |
| 2024288 | 1/1980 | United Kingdom | 104/2 |

OTHER PUBLICATIONS

"Progressive Railroading": Feb. 78, p. 68; Mar. 64, pp. 93/4; Feb. 86, pp. 45, 46.

"Railway Track and Structures": Dec. 68, pp. 14–16; Jun. 78, pp. 28, 29 & 31; Nov. 83, pp. 22–24; Sep. 85, pp. 49, 64, 58, 61, 66, 105 & 106.

*Primary Examiner*—Stephen M. Hepperle
*Attorney, Agent, or Firm*—Kurt Kelman

[57] ABSTRACT

A mobile apparatus for sequentially exchanging selected consecutive groups of old ties for groups of new ties while retaining a groups of old ties between the selected old ties for support of the mobile apparatus on the railroad track, which apparatus comprises an elongated bridge-like work vehicle having two undercarriages supporting respective opposite ends of the work vehicle on the railroad track, and a succession of different individual devices mounted on the work vehicle between the undercarriages and operative to effectuate different sequential operations for exchanging the selected old ties for the new ties.

28 Claims, 6 Drawing Sheets

MOBILE TIE GANG APPARATUS

This is a continuation of our copending patent application Ser. No. 97,757, filed Sept. 17, 1987, now abandoned.

The present invention relates to a mobile apparatus for sequentially exchanging selected consecutive groups of, for example three, old ties for groups of new ties while retaining groups of, for example three, old ties between the selected old ties for support of the mobile apparatus on the railroad track. Preferably, this apparatus is combined with a train for loading, transporting and unloading the ties on, in and from open top railroad cars.

U.S. Pat. No. 4,253,398, dated Mar. 3, 1981, discloses a mobile installation for exchanging old ties for new ties, which comprises a train of flat top cars for transporting the ties, a work vehicle comprising a first vertical tie conveyor for picking up the old ties and a second vertical tie conveyor for laying the new ties, tie conveyor means for moving the old ties from the first vertical tie conveyor and for moving the new ties to the second vertical tie conveyor, and a gantry crane for transporting the old and new ties to and from the flat top cars. Turning devices at the vertical tie conveyors enable the ties to be turned 90° between a position extending transversely to the railroad track and one extending parallel thereto to enable the ties to be moved on the tie conveyor means longitudinally aligned with each other. This installation enables a complete tie exchange to be effected as it moves continuously along the railroad track.

It is also known and has been the accepted procedure for many types of railroad tracks to exchange only groups of ties at any one time, i.e. to renew only groups of at least one old tie, for example two or three ties, while retaining groups of at least one old tie, for example two or three ties, between the selected ties for support of the mobile apparatus on the railroad track, and to repeat this procedure every few years until eventually all the ties have been exchanged.

U. S. Pat. No. 4,175,902, dated Nov. 27, 1979, and No. 4,190,394, dated Feb. 26, 1980, disclose an apparatus and method for loading and unloading open top or gondola railroad cars used in the exchange of every third tie, for example. The apparatus comprises a train mounted for mobility along the railroad track and includes a plurality of the open top railroad cars having a considerable loading volume, adjacent ones of the railroad cars being coupled together and each railroad car having two high parallel side walls with top edges and two high end walls, the ed walls of the adjacent railroad cars defining respective gaps therebetween, and a power-driven crane with booms for loading and unloading the ties and having two undercarriages supporting the crane for mobility in the direction of the railroad track. The undercarriages have pneumatic tires to enable the crane to be moved along a road or the railroad track, and the crane also has pivoted gliding feet or brackets for gripping the top edges, the relatively widely spaced top edges of the railroad cars serving as a track for moving the crane along the cars while the gliding feet grip the top edges. A cable is attached to the crane to pull the crane along the railroad cars as it is perched atop the cars. Operation of this apparatus requires great skill and a number of sometimes life-threatening manual steps. The movement of the crane between adjacent cars is particularly difficult and very time-consuming, which considerably reduces the efficiency of the operation. The crane movement along and between the cars is quite unstable, providing unsafe operating conditions and frequent interruptions. In addition, the tractor used for the crane must be specially designed to enable the crane to effectuate the required forward and rearward movements on the top edges of the gondola cars.

U.S. Pat. No. 4,096,954, dated June 27, 1978, and No. 4,099,635, dated July 11, 1978, disclose a gondola car loader and tie handler, as also described on page 68 of "Progressive Railroading", February 1978, which also uses a power-driven crane movable atop a train of gondola cars. Two beams may be pivotally mounted on the chassis of the crane at each side thereof and these pivotal beams carry two flanged wheels for guidance of the crane chassis along the top edges of the gondola cars. The spacing between the guide wheels corresponds at least to the gap between adjacent cars. Each beam is pivotal at the center thereof for rotation about a transversely extending axis and is connected to a pivoting drive so that the front beams may be swung upwardly when the crane is moved from one to the next car, the crane being advanced until the wheels of the front beams may be engaged with the top edges of the next car. The beams are then swung down while the rear beams are pivoted upwardly and then lowered again when their wheels are engaged with the top edges of the next car. The operation of this apparatus is also slow and uneconomical, the movement of the crane being unstable and, therefore, unsafe for the operating personnel. Bridging the cars is not only difficult and time-consuming but is highly accident-prone in view of the heavy weight of the crane.

The above-described mobile installations with a power-driven tie loading and unloading crane movable atop a train of gondola cars have such a low efficiency that they cannot be used economically usefully in tie exchange operations since they would cause long sections of track to be blocked for long periods for normal train traffic.

A mechanized tie gang useful in exchanging groups of ties, for example groups of two or three ties between retained groups of two or three ties, has been described on pages 22 to 24 of "Railway Track and Structures", November 1983, and this may be used in combination with the above-described gondola car loaders and unloaders for removing the old ties from the tie gang and moving the new ties thereto. This mechanized tie gang comprises up to 24 pieces of equipment, such as tie cranes, spike pullers, tie shears, tie cranes for handling tie butts, rotary scarifiers, tie injectors, tampers, rail lifts, spikers and ballast regulators. In the operation of this tie gang, the old ties are withdrawn and placed on the shoulders of the track after optionally being sawn into chunks and they are then loaded onto railroad cars. The new ties are placed on the track shoulders for insertion. The loading and unloading of the ties may be effected at a different time than the tie exchange operation.

The mobile tie exchange apparatus comprises a succession of coordinated and different individual devices operative to effectuate different sequential operations for exchanging the selected ties, such as tie exchange operating devices equipped for pulling spikes, removing old tie plates, withdrawing old ties, scarifying the ballast, inserting new ties, placing new tie plates and driving new spikes. These tie exchange operating devices are suitably spaced from each other in the direction of the railroad track for coordinated operation. Some of such devices are shown in the September 1985 issue of "Railway Track and Structures", including the tie remover/inserter described and illustrated on pages 49 and 64, the self-propelled tie saw on page 58, the spike puller and hydraulic track lifter on page 61, the mechanized plate handling machine on page 66, the anchor tightening machine on page 105, and the spike setter-driver on page 106. Each of these machines are individually operated, self-propelled devices having their own undercarriages for supporting them on the railroad track.

In addition to the above-mentioned mechanized tie gang, other tie-renewal gangs are described on pages 28, 29 and 31 of "Railway Track and Structures", June 1978, and on pages 14 to 16 of the December 1968 issue of this publication. All of these known mechanized tie gangs are comprised of varying numbers of some 14 to 24 individual self-propelled machines, operating personnel being stationed between some of these machines for effectuating additionally required operating steps. The exchange of every third or fourth tie is effected with these known mechanized tie gangs by first removing the tie clips or anchors from the track, then pulling the spikes, removing the old tie plates, withdrawing every third or fourth tie, optionally sawing the withdrawn tie into chunks, placing the withdrawn ties or tie chunks on the track shoulder, scarifying the ballast, i.e. excavating it, in the areas of the track bed which supported the withdrawn ties, inserting new ties in these scarified track bed areas, the new ties having been conveyed to, or stored on, the track shoulder laterally adjacent these areas, whereupon new tie plates are inserted between the inserted new ties and the slightly raised railroad track rails, the new ties are tamped, new spikes are driven into the new ties to fasten the rails thereto, and the tie clips or anchors are applied again. In this connection, an independently operating tie plate distributor car, such as described and illustrated on pages 93 and 94 of "Progressive Railroading", March 1984, may be used for transporting and storing the old and new tie plates. The old and new ties may be loaded, transported and unloaded at the same time or another time by a mobile loader and unloader installation of the first-described type. After the tie exchange has been completed, the ballast supporting the track may be regulated and shaped, and the track ties may be tamped, with a concomitant track correction, for example by means of a track tamping, leveling and lining machine of the type disclosed in U.S. Pat. No. 4,534,295, dated Aug. 13, 1985.

A tie renewal operation with the individual machines hereinabove described does not only require a large number of operators, including control and monitoring personnel, but also blocks long track sections and their neighboring tracks for a long time so that train traffic is interrupted for extended periods. The efficiency is low because it is exceedingly difficult to coordinate the operation of the many individual machines which are spaced from each other along the railroad track, causing numerous interruptions in the operation. In addition, if an attempt is made to pass some trains on a neighboring track even at low speed, the operators are exposed to danger.

It is the primary object of the present invention to improve apparatus for sequentially exchanging selected consecutive groups of old ties, such as three ties at a time, for groups of new ties while retaining groups of old ties between the selected old ties for support of the mobile apparatus on the railroad track, particularly in combination with a mobile installation for loading, transporting and unloading the ties on, in and from open top railroad cars, so that it may be operated more efficiently, simply and safely, and to construct the same so that the multiple different operations may proceed smoothly and without interfering with each other, thus facilitating the monitoring and control of the operations. As a result, the entire renewal operation can proceed rapidly along existing track and will interfere minimally with train traffic over the track.

The above and other objects are accomplished according to the invention with a mobile apparatus which comprises an elongated bridge-like work vehicle having two undercarriages supporting respective opposite ends of the work vehicle on the railroad track, and a succession of different individual devices mounted on the work vehicle between the undercarriages and operative to effectuate different sequential operations for exchanging the selected old ties for the new ties.

According to a preferred aspect of this invention, such an apparatus is combined with a mobile installation for loading, transporting and unloading the ties on, in and from open top railroad cars, which installation comprises (a) a train mounted for mobility along a railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (b) a power-driven crane for loading and unloading the track parts and having an undercarriage supporting the crane for mobility in the direction of the railroad track, and (c) a track supporting the undercarriage of the crane for mobility above the top edges of the railroad cars in said direction, the track comprising two parallel guide rails mounted on the top edges of the railroad cars and being spaced apart a distance corresponding to the gage of the crane undercarriage, the guide rails extending beyond the end walls of the railroad cars into the gaps between the adjacent cars to provide an essentially continuous track for support of the crane undercarriage along the train of cars.

The use of elongated bridge-like work vehicles has the advantage of enabling the different individual tie exchange operating devices to be coordinated in such a manner that the tie exchange proceeds on the principle of an assembly line operation, thus essentially improving the efficiency as compared to the use of separate machines moving independently along the railroad track for effectuating the sequential tie exchange operations. This arrangement also makes it possible to use more than one of the same tie exchange operating device in the coordinated sequence of different such devices to adjust the operating efficiency of the same devices to that of the different devices. The use of suitable tie conveyors, particularly in combination and coordination with the operation of the crane on the mobile installation, makes it possible to transport the old and new ties independently of the operation of the tie exchange operating devices to avoid storing such ties, for example, on a laterally adjacent railroad track, which would interfere with train traffic on that adjacent railroad track. The new ties may be transported directly to the point where the selected old tie was removed and may be lowered onto the rails of the railroad track at this point, which makes it possible for a tie inserter at this point to grasp the new tie and to insert it rapidly under the rails. The tie conveyors on the bridge-like work vehicle can constitute a continuous tie conveying path in combination with the guide track for the crane.

Mounting an essentially continuous guide track for the undercarriage of the crane on the top edges of the open top railroad cars makes full use of the rigidity of the top edges for support of the guide rails and provides a track on which a conventional power-driven crane with its usual pivotal boom may be readily and safely supported and moved without any complex support and other auxiliary equipment. Since the guide rails project into the gaps between adjacent cars, they provide a secure and safe support and guide for moving the crane from one car to the other, even in track curves. Conventional open top or gondola cars may be used without any modifications, such as reinforcements of the top edges, since the guide rails are simply detachably fastened or spot-welded to the top edges. The guide track for the crane along the top edges of the railroad cars leaves the car openings unencumbered and does not interfere with the rapid hoisting or lowering of goods from and into the cars. Thus, the cars may be used in any conventional manner as box cars operating without a crane moving along their tops.

The above and other objects, advantages and features of this invention will become more apparent from the following detailed description of certain now preferred embodiments thereof, taken in conjunction with the accompanying somewhat schematic drawing wherein FIG. 1 is a side elevational view of a mobile installation for loading, transporting and unloading ties on, in and from open top railroad cars, comprising a train of two such cars and an optional work vehicle preceding these cars and equipped with individual spike pulling devices, as indicated in chain-dotted lines;

Figures 5, 6, 7, 8:
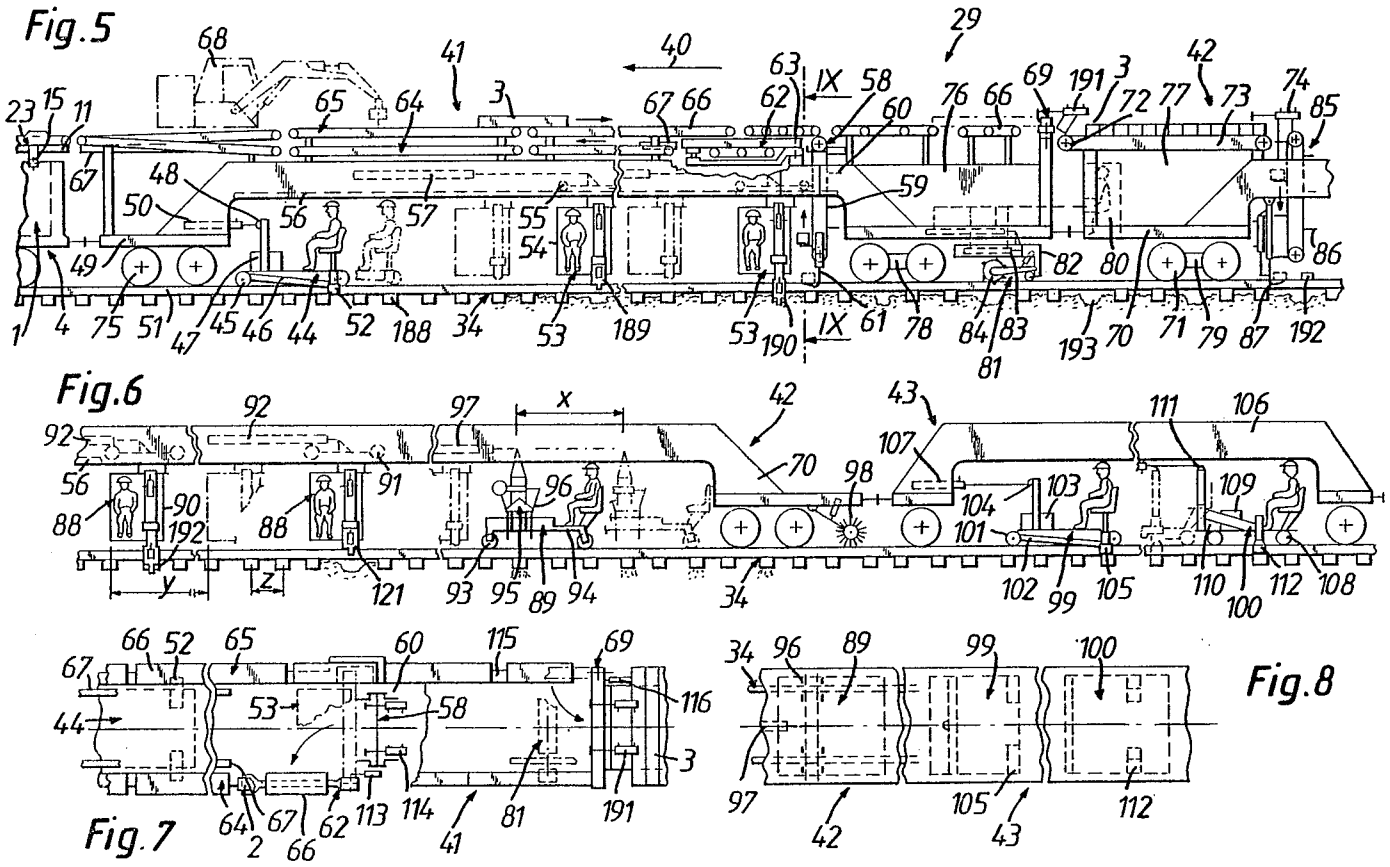
Figure 9:
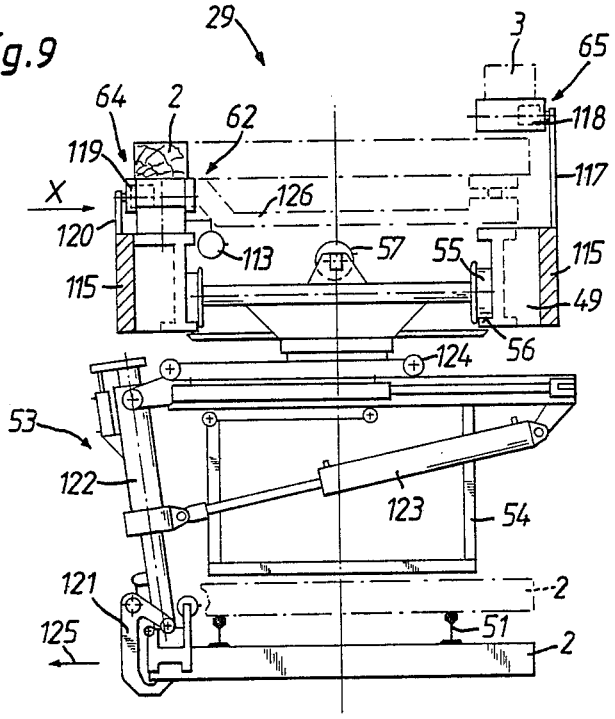
Figure 10:
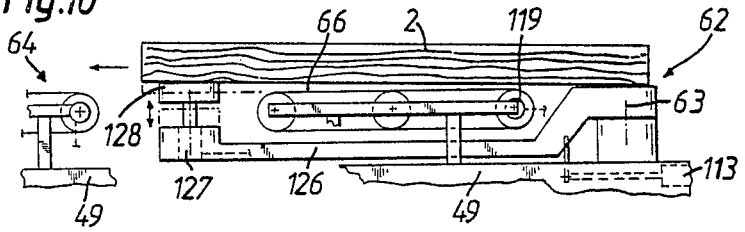
Figure 11:
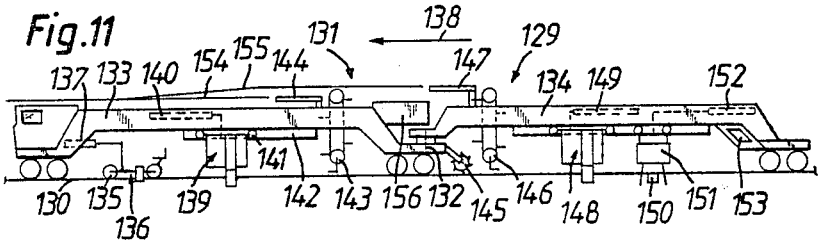
Figure 12:
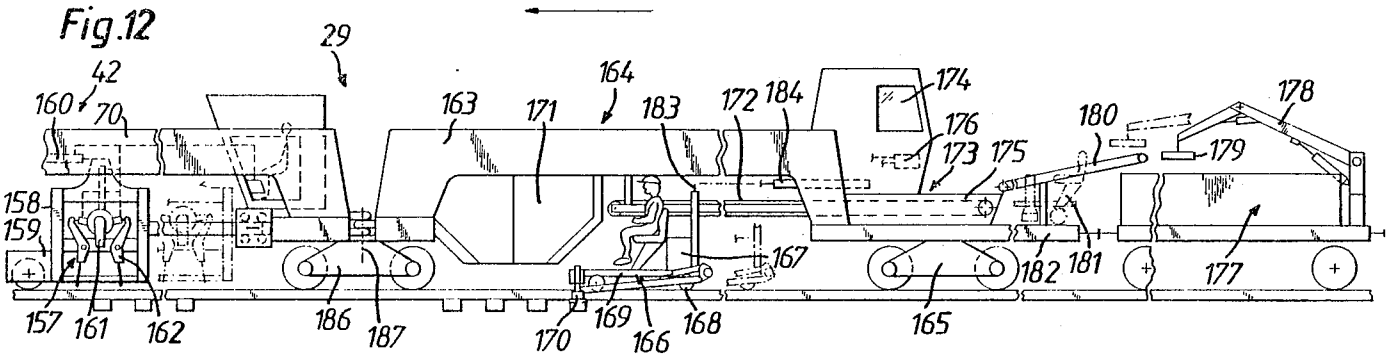
Figure 13:
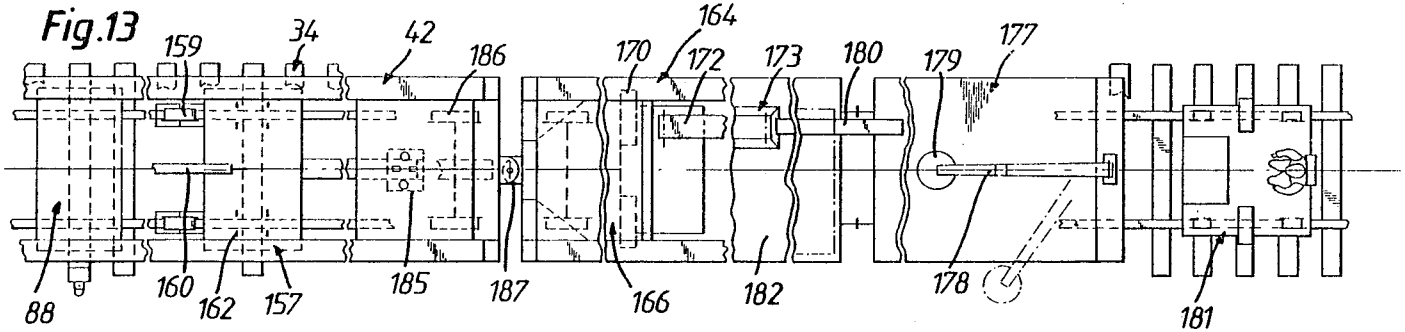
Figure 14:
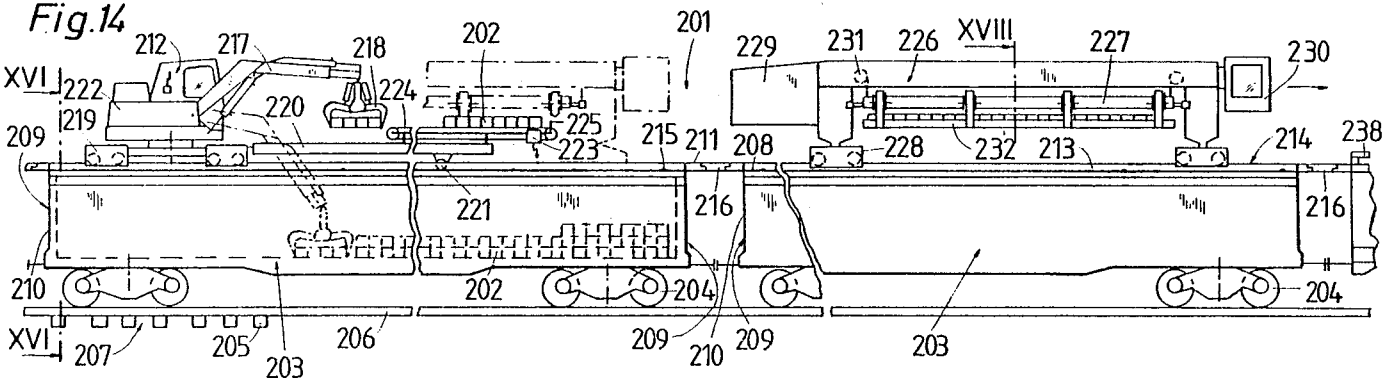
Figure 15:
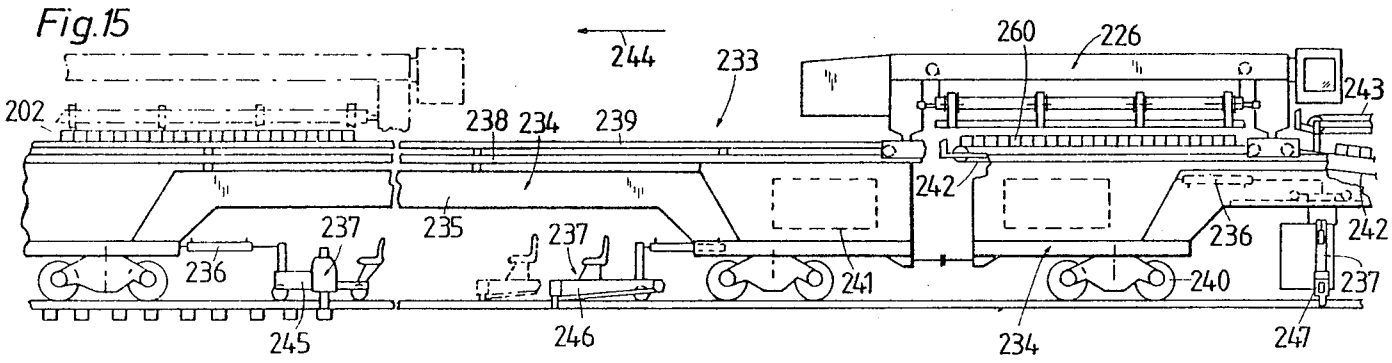
Figure 17:
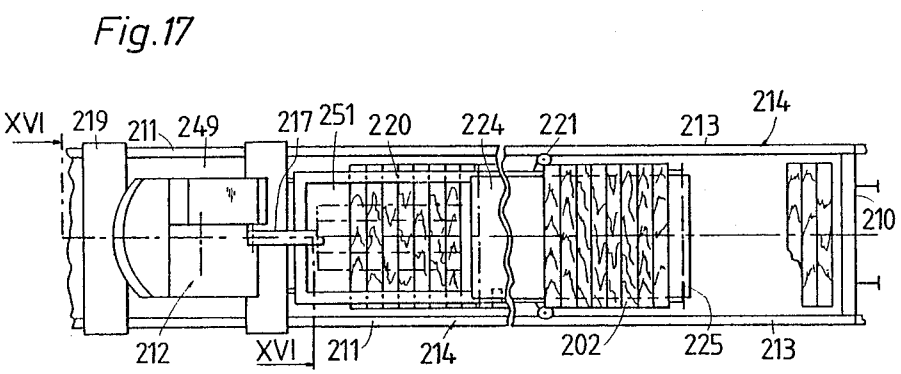
Figure 20:
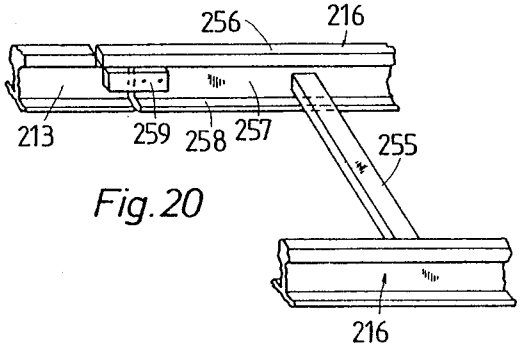
Figure 19:
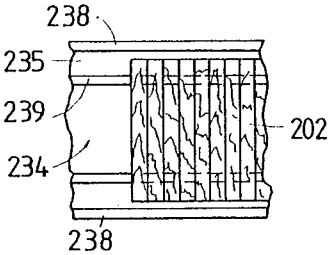
Figure 16:
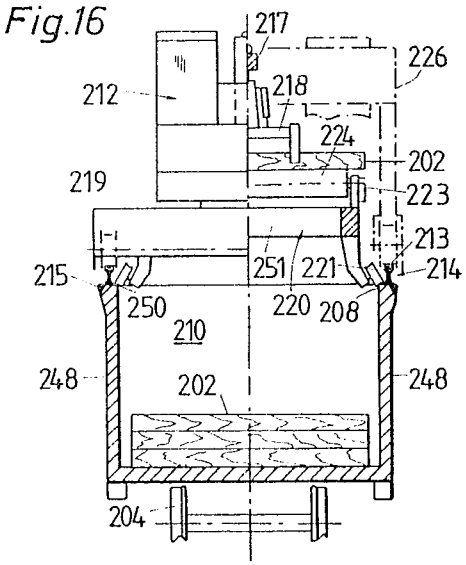
Figure 18:
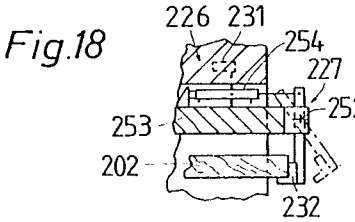

FIGS. 5 and 6 together show a side view of a mobile tie loading, transporting and unloading installation combined with a mobile apparatus for sequentially exchanging selected consecutive groups of old ties for groups of new ties in an existing railroad track, including an only partially illustrated freight car for carrying ties;

FIGS. 7 and 8 are respective fragmentary top views of the installation and apparatus of FIGS. 5 and 6;

FIG. 9 is an enlarged transverse cross section along line IX—IX of FIG. 5, illustrating a tie puller;

FIG. 10 is a side view taken in the direction of arrow X in FIG. 9, illustrating a turning device for the pulled ties;

FIG. 11 is a diagrammatic side view of another embodiment of a mobile tie exchange apparatus, with a bridge-like work vehicle having two pivotally coupled parts and equipped with longitudinally displaceable tie exchange operating devices;

FIG. 12 is a side elevational view of another embodiment of the mobile tie exchange apparatus, including an only partially shown second work vehicle equipped with a track tamper, a third work vehicle trailing the second one and a storage car for removed tie plates trailing the third work vehicle;

FIG. 13 is a top view of FIG. 12;

FIG. 14 is a side elevational view of another embodiment of a mobile installation with a train comprising two open top railroad cars and a power-driven crane movable atop the cars along the train;

FIG. 15 is a side elevational view of a mobile tie exchange apparatus with two bridge-like work vehicles equipped with a plurality of different tie exchange operating devices, combined with a tie transport car;

FIG. 16 is an enlarged transverse cross section along line XVI—XVI of FIGS. 14 and 17;

FIG. 17 is an enlarged top view of an open top railroad car of FIG. 14, with the power-driven crane and a longitudinally extending tie conveyor band;

FIG. 18 is an enlarged fragmentary view of the gantry crane of FIG. 14, along line XVIII—XVIII;

FIG. 19 is an enlarged fragmentary top view of the leading work vehicle shown in FIG. 15, illustrating the ties carried on the vehicle; and FIG. 20 is an enlarged fragmentary perspective view of a crane guide track with an intermediate track section comprising two guide rails braced by cross rod.

Referring now to the drawing and first to FIGS. 1 to 4, there is shown mobile installation 1 for loading, transporting and unloading such track parts as old ties 2 and new ties 3 on, in and from open top railroad cars 4. The installation comprises a train mounted for mobility in an operating direction indicated by arrow 40 along railroad track 34 and including a plurality of open top railroad cars 4. Adjacent railroad cars are coupled together and each car has chassis 5 supported on the railroad track by undercarriages 6 and mounting two parallel side walls 7 with top edges 9 extending in the direction of railroad track 34 and two end walls 8 extending perpendicularly thereto. The side and end walls of each railroad car define a storage space into which bundles of ties may be loaded. The end walls of adjacent railroad cars 4 define respective gaps 10 therebetween.

Track 11 supports undercarriage 13 of power-driven crane 12 for loading and unloading ties 2, 3 for mobility in the direction of railroad track 34 above top edges 9 of railroad cars 4. This track comprises two parallel guide rails 14 mounted on top edges 9 and spaced apart a distance corresponding to the gage of the crane undercarriage 13, the guide rails extending beyond end walls 8 of railroad cars 4 into gaps 10 between the adjacent cars to provide a substantially continuous track for support of the crane undercarriage along the train of cars.

In this embodiment of the installation, the track is detachably affixed to top edges 9 of railroad cars 4 by means 15. The illustrated detachable affixing means comprises a succession of U-shaped claws 16 (see FIG. 3) shaped to be positioned on, and grip, top edges 9. Such detachable affixing means enables guide rails 14 to be readily and rapidly mounted and detached. The cross section of the claws is designed to prevent lateral gliding of the affixing means so that the claws firmly hold the guide rails in place. Furthermore, as schematically illustrated in FIG. 1, the claws near the respective end walls 9 may be fastened to side walls 7 of the railroad cars, for example by clamping screws, to prevent displacement of the guide rails in a longitudinal direction.

Illustrated track 11 is comprised of a succession of, for example four, track sections 17 independently detachable from top edges 9 of a respective railroad car 4, each track section having two pairs of transversely aligned claws 16. Crossbeams 18 interconnect the claws of each pair. Arranging the track in sections simplifies and facilitates the handling of the track during mounting and detachment, the weight of each track section being a fraction of the total track weight. The cross beams brace the guide rails and provide a more stable track for the heavy power-driven crane and its loads.

Figure 1:
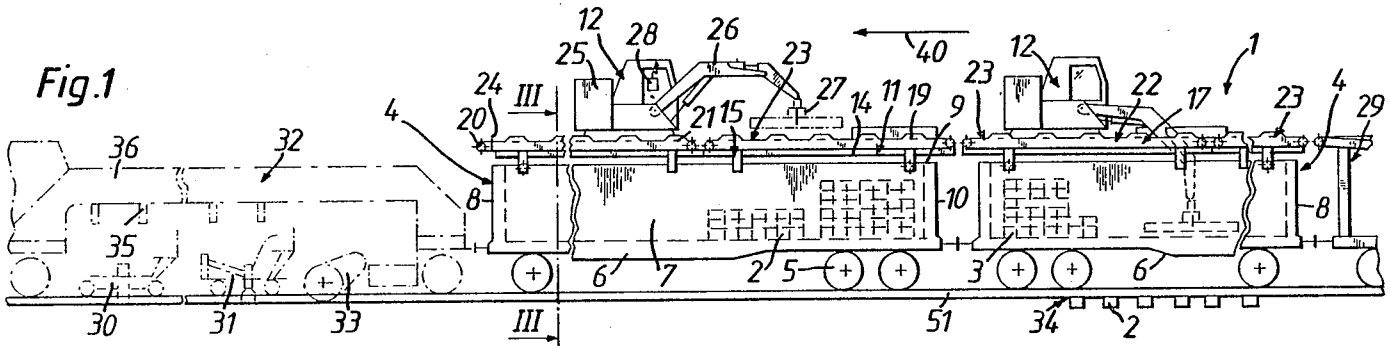
Figure 2:
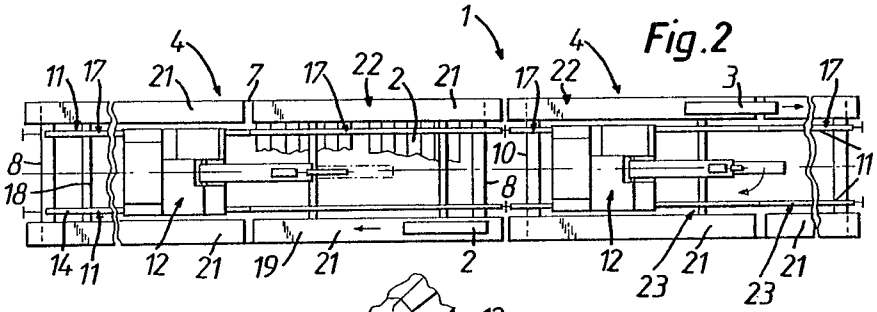
FIG. 2 is a top view of the two open top railroad cars of the train of FIG. 1.
Figure 3:
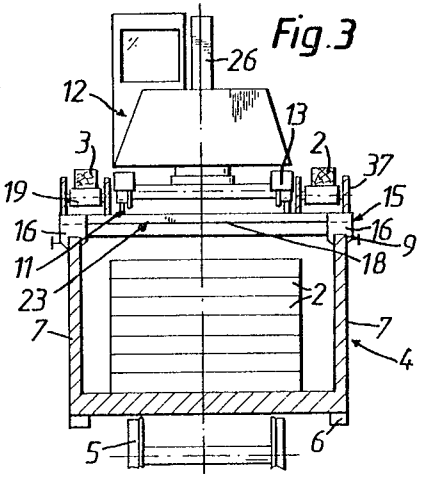
FIG. 3 is an enlarged transverse cross section of a railroad car, along line III—III of FIG. 1.
Figure 4:
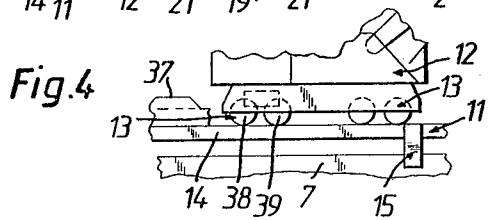
FIG. 4 is an enlarged fragmentary side view showing two-axle undercarriages for the power-driven crane moving atop the railroad cars.

As illustrated, installation 1 further comprises continuous tie conveyor 19 extending alongside the guide rails of track 11 above top edges 9 of railroad car 4 and beyond end walls 9 thereof for transporting ties 2 and 3, each conveyor being positioned laterally outside the track supporting the crane, as shown in FIGS. 2 and 3. As illustrated in FIG. 2, each continuous tie conveyor 19 comprises a succession of, for example four, endless conveyor bands 21 and independent drive 20 for each endless conveyor band so that each endless conveyor band 21 and drive 20 constitutes a conveyor section 22 detachably positionable on a respective railroad car 4. In the illustrated embodiment, each conveyor section 22 is affixed to an associated track section 17 whereby a succession of, i.e. four, independently detachable track and conveyor units 23 are formed. Arranging the tie conveyors adjacent the crane track provides a particularly efficient loading and unloading system for ties 2 and 3, old ties 2 being preferably unloaded from the train and new ties 3 loaded on the train at one end thereof. As shown in FIG. 1, it is advantageous to operate several power-driven cranes 12 simultaneously for receiving new ties from one of the conveyors and loading old ties on the other conveyor. This provides a simple arrangement for efficiently handling the old and new ties at the same time. Providing independently detachable track/conveyor units greatly facilitates the erection and disassembly of the entire system. Railroad track 34 and track 11 supporting cranes 12 have substantially the same gage, and this enables ordinary cranes to be used without any need for adaptation to the loading and unloading installation of this invention. The track-/conveyor units are sturdy and the efficiency of the loading and unloading operation makes it possible to complete the same in a relatively short time, which holds the down-time of the railroad track to a minimum.

As shown in FIG. 1, stop 24 is actuatable by a respective tie upon engagement therewith for de-activating drive 20 of endless conveyor band 21 transporting the ties. Remote radio control 28 in an operator's cab on crane 12 enables drive 20 to be actuated. The stop de-activating the drive prevents the ties to be transported uncontrolled beyond the reach of the crane so that the further conveyance of the ties by the endless conveyor band is interrupted independently of the work of the crane. When the operating capacity of the crane permits, the remote control of the drive by the crane operator enables the conveyor band to be driven again so that additional ties are transported to the crane.

Each crane 12 has its own power plant 25 for driving the crane and a pivotal hoisting outrigger 26 carrying a rotatable tie gripping device 27 at a free end thereof.

The hereinabove-described loading and unloading system comprised of units 23 makes it possible to use standard box cars, so-called gondola cars, without any special adaptation. Several such track/conveyor units 23, preferably four, may be installed on each car and the train may be comprised of any desired number of cars 4, for example up to 10 or 15 cars, the number of railroad cars used depending on the number of ties to be renewed in a given railroad track section.

Such a mobile installation 1 is advantageously used in combination with mobile apparatus 29 for sequentially exchanging selected consecutive groups of, say 3, old ties for groups of new ties while retaining groups of, say 3, old ties between the selected old ties for support of the mobile apparatus on the railroad track, which apparatus is indicated only fragmentarily in FIG. 1 and will be described in detail hereinafter in connection with FIGS. 5 and 6. In this case, the installation may further comprise self-propelled work vehicle 32 (shown in dash-dotted lines) preceding the train of open railroad cars 4 and coupled thereto whereby the work vehicle constitutes a locomotive for the train. The work vehicle comprises frame 36 whose ends are supported on railroad track 34 by undercarriages and which carries manually or automatically operable spike pulling devices 30, 31 and magnetic spike collecting device 33. Each spike pulling device runs on the railroad track and is independently propelled therealong for displacement with respect to work vehicle frame 36 whereto it is coupled by linkage 35 so that it may be retracted in transit. It is possible, of course, to use mobile installation 1 with a standard locomotive independently of mobile apparatus 29 and work vehicle 32 for other loading, transporting and unloading operations involving other goods, rather than track parts, such as ties. The installation can be operated efficiently in assembly-line fashion for the parallel unloading of old ties and loading of new ties.

FIG. 3 clearly illustrates the loading room provided in each car 4 for stacks of old ties 2. This figure also shows the ready mounting of track/conveyor units 23 on top edges 9 of side walls 7 of the cars. To prevent ties 2 and 3 from slipping sidewardly off conveyors 19 sheet metal guides 37 are mounted to project above the upper runs of the endless conveyor bands. As shown, track 11 supporting the undercarriage of crane 12 for mobility is centered above the open top railroad car. In the embodiment illustrated in FIG. 4, the crane has two undercarriages 13 for bridging over gaps 10 between the tracks on adjacent railroad cars 4, the undercarriages being two-axled (38, 39) swivel trucks for mobility in curves. With the centered arrangement of track 11, outrigger 26 with its tie gripping device 27 has unhindered access to the ties in car 4 so that the ties may be hoisted without any obstacle. The double-axled undercarriages of the crane enable it to move securely from car to car.

FIGS. 5 and 6 more fully illustrate mobile apparatus 29 for exchanging selected consecutive groups of old ties for groups of new ties while retaining groups of old ties between the selected old ties for support of the mobile apparatus on the railroad track, which comprises a succession of elongated bridge-like work vehicles 41, 42 and 43. Each work vehicle has two undercarriages supporting respective opposite ends of the work vehicle on railroad track 34 and a succession of respective different individual devices mounted on each work vehicle between the undercarriages and operative to effectuate different sequential operations for exchanging the selected old ties for new ties. First work vehicle 41 in the operating direction of mobile apparatus 1 indicated by arrow 40 comprises individual tie exchanging device 44 equipped for detaching old tie plates. Tie plate detaching device 44 has guide wheels 45 supporting the device on railroad track 34 and its own drive 47 to make device 44 self-propelled and self-propelled device 44 comprises drive 50 for the displacement of the device during a tie exchange operation, and coupling 48 connects the device to work vehicle 41. The tie plate detaching device also has an operator's seat in the range of operating units 52 arranged adjacent rails 51 of the railroad track to enable an operator to actuate the operating units for detaching the tie plates. The first work vehicle further comprises two additional tie exchange operating devices 53 equipped to withdraw respective old ties 2 laterally from railroad track 34 and to place the old ties on the railroad track. Tie pulling devices 53 have guide rollers 55, such as flanged wheels, engaging common guide track 56 and suspending the devices on first work vehicle 41, individual tie exchange operating devices 44 and 53 being spaced from each other in the operating direction on the first work vehicle. Such a mounting of the longitudinally displaceable tie exchange operating devices has the advantage that no further work is required for vertically positioning the devices either during transit or during their operation. A respective longitudinal displacement drive 57 is affixed to machine frame 49 of the work vehicle and is connected to each tie pulling device 53 (see also FIG. 9). Vertical conveyor 58 is fixedly mounted on the first work vehicle rearwardly of the displaceable tie exchange operating devices and immediately ahead of the rear undercarriage for vertically conveying old ties 2 placed on the railroad track. The vertical conveyor has an endless conveyor chain 59 trained over driven pulleys and carrying a series of entrainment plates 60 for picking up and supporting the old ties. A pair of transversely aligned lifting hooks 61 are mounted at the lower end of vertical conveyor 58 and may be vertically adjusted by a drive between a lower position below the upper edge of rails 51 and an upper position at the level of the lower pulley over which the conveyor chain is trained for lifting the old ties off the railroad track. Ballast scarifier 81 is mounted rearwardly of the rear undercarriage of first work vehicle 41. The ballast scarifier has carrier frame 82 with wheels supporting the scarifier on railroad track 34 and longitudinal displacement drive 83 connects the ballast scarifier to the work vehicle for displacement in the operating direction. Frame 82 carries drum 84 whose surface has a multitude of teeth and which is rotatable about an axis extending transversely to the operating direction. Rotatable drum 34 has a rotating drive and comprises two transversely adjacent sections, a central section being designed for smoothing the ballast between the rails of the railroad track while two narrower side sections smooth the ballast along the track shoulders.

Second work vehicle 42 succeeds first work vehicle 41 in the operating direction indicated by arrow 40 and comprises vertical conveyor 85 fixedly mounted on machine frame 70 of the second work vehicle rearwardly of front undercarriage 71 for vertically conveying new ties 3 to railroad track 34, two individual tie exchange operating devices 88 equipped to insert respective new ties 3 into the railroad track and tamping unit 89 for tamping ballast under the inserted new ties. Tie inserters 88 are identical with tie pullers 53 and comprise carrier frames 90 having guide rollers 91 suspending them on guide track 56 on second work vehicle 41 and respective drives 92 displace the tie inserters with respect to the work vehicle. The tie inserters are spaced from vertical tie conveyor 85 and from each other in the operating direction on the second work vehicle. Vertical conveyor 85 has an endless conveyor chain trained over driven pulleys and carrying a series of entrainment plates 86 for supporting the new ties. A pair of transversely aligned lifting hooks 87 are mounted adjacent the vertical conveyor and may be vertically adjusted by a drive between a lower position below the upper edge of rails 51 and an upper position at the level of the lower pulley over which the conveyor chain is trained for lifting the old ties off the railroad track. Tamping unit 89 has tamping tool carrier 94 with guide rollers 93 displaceably supporting the tamping unit on railroad track 34 and tamping head 95 with reciprocable vibratory tamping tools 96 is vertically adjustably mounted on the tamping tool carrier. An upper end of tamping tool carrier 94 is connected to machine frame 70 of the second work vehicle by longitudinal displacement drive 97 and the tamping tool carrier holds an operator's seat with a control panel enabling an operator to operate the tamping tool unit. By distributing the different individual tie exchange operating devices in coordinated sequence over two coupled work vehicles, these devices may be spaced sufficiently from each other in the operating direction to avoid interfering with each other during their respective operations. The arrangement of the vertical conveyor for the old ties at the rear end of the first work vehicle enables the withdrawn old ties placed on the railroad track to be removed before the new ties are inserted with the devices on the succeeding second work vehicle, and the vertical conveyor at the front end of the second work vehicle enables the new ties to be placed on the railroad track for insertion thereunder by the succeeding tie inserters.

The longitudinal displaceability of the individual tie exchange operating devices by their respective displacement drives enables each device to be placed into a position accurately designed to conform to that of the tie to be handled and relative to each other. In this way, the work vehicles may be intermittently advanced, for example by distances corresponding to five to ten tie spacings per individual tie exchange operating device while each such individual device may be displaced longitudinally relative to the machine frame for centering the device with respect to the tie to be handled. Using just two coupled work vehicles with suitably coordinated individual tie exchange operating devices provides a very compact mobile apparatus of advantageous construction designed for the effective coordination of all required tie exchange operations for selected groups of ties of an existing railroad track.

Providing an individual tie exchange operating device with its own drive and coupling it to the machine frame of the work vehicle enables known devices of this type to be retrofitted into the mobile apparatus of the present invention with a minimum of adaptation and since these devices are self-propelled, they may be displaced independently of the advance of the mobile apparatus for proper centering with respect to the tie being handled. Since the devices are coupled to the machine frame of the work vehicle, they may be moved therewith during transit while their independent drives enable them to be independently displaced during the operation of the apparatus. The couplings may be so constructed that they enable the devices to be retracted from the railroad track during transit of the work vehicle.

As shown in FIG. 5, first and second work vehicles 41 and 42 are coupled to each other at facing ends thereof, and the facing work vehicle ends support power plants 76, 77 for supplying power, such as hydraulic fluid, to the drives of the individual tie exchange operating devices as well as to drives 78 and 79 for continuously advancing the work vehicles. Furthermore, operator's cab 80 is mounted at the front end of the second work vehicle within view of ballast scarifier 81 and comprises control and monitoring means for the individual tie exchange operating devices and drives. The more or less centrally arranged operator's cab enables an operator not only to control and monitor the operations but also to gain an overview over the completed work. The arrangement of the power plants at the facing ends of the first and second work vehicles enables the work vehicles to be constituted by long bridge-like machine frames on which a relatively large number of different individual tie exchange operating devices may be properly spaced for effectuating a complete tie exchange operation.

Drive means 78, 79 enables mobile apparatus 29 to be continuously advanced in the operating direction and the displacement path of the individual tie exchange operating devices permits relative movement between the devices and the work vehicle to hold the devices in place during their respective operations while the apparatus continuously advances. This produces rapid progress of the tie exchange operation and a correspondingly short down-time for the railroad track. The length of the displacement path preferably slightly exceeds the sum of the distances between three ties if every third tie is to be exchanged. This makes it possible to move individual tie exchange operating devices back and forth along their displacement path to permit them to operate properly without interference with each other.

As shown in FIG. 5, first work vehicle 41 further comprises first conveyor means 64 mounted on top of machine frame 49 of the first work vehicle for receiving successive longitudinally aligned old ties 2 and conveying the same from vertical conveyor 58 and second conveyor means 65 also mounted on top of the first work vehicle machine frame for conveying successive longitudinally aligned new ties 3. Each tie conveyor means is comprised of a succession of conveyor means sections 66 each consisting of a driven endless conveyor band, a respective conveyor means being mounted at a respective side of first work vehicle 41. The first work vehicle also comprises driven tie turning device 62 arranged between vertical tie conveyor 58 and first tie conveyor means 64 for receiving old ties 2 from the vertical tie conveyor and turning them 90° about vertical axis 63 from their transversely extending position on the vertical conveyor to longitudinal alignment of the successive old ties on conveyor means 64. First tie conveyor means 64 has a discharge end disposed at the same level as second conveyor means 65 and continues from the discharge end to tie turning device 62 at a lower level than the second conveyor means. The lower level of the first conveyor means is spaced from the level of the second conveyor means by a distance corresponding at least to the height of the ties whereby the old ties may be freely turned by the turning device without interference by the second conveyor means. First work vehicle 41 further comprises standard-gage track 67 consisting of two parallel guide rails mounted on top of the first work vehicle and leading to turning device 62 between conveyor means 64 and 65, the guide rails being spaced apart a distance corresponding to the spacing of the two parallel guide rails 14 mounted on top edges 9 of open top railroad cars 4, the two parallel guide rails on top of work vehicle 41 continuing track 11 supporting the undercarriage of crane 68.

This arrangement provides a continuous tie conveyance and transport path along mobile installation 1 and mobile apparatus 29 and enables the power-driven crane to be moved to the first work vehicle of the mobile apparatus for loading and unloading of the old and new ties. The tie turning device between vertical conveyor 58 and conveyor means 64 enables old ties 2 to be conveyed over considerable distances without interference with the operation.

As also shown in FIG. 5, first work vehicle 41 further comprises another driven tie turning device 69 arranged at one end of the first work vehicle on top of machine frame 49 for receiving longitudinally aligned new ties 3 from a discharge end of second tie conveyor means 65 and turning them 90° about a vertical axis from a longitudinally extending position shown in chain-dotted lines to a transversely extending position shown in full lines. Second work vehicle 42 comprises endless conveyor band 73 mounted atop machine frame 70 and driven by driven pulley 72 to convey turned new ties 3 to a discharge end. This conveyor band conveying the new ties in transverse position provides storage for a considerable number of new ties so that the subsequent insertion of the new ties may proceed uninterrupted during the continuous advance of the apparatus even if there is a temporary interruption of the supply of new ties. Tie transferring devices 191 and 74 are respectively arranged at new tie turning device 69 and at the discharge end of endless conveyor band 73 to transfer the new ties between turning device 69 and the endless conveyor band, and therefrom to a succeeding vertical new tie conveyor 85. Each tie transferring device is comprised of a pair of transversely aligned hydraulic cylinders whose piston rods carry hooks at their free ends for engagement with the new ties. The hydraulic cylinders are pivotal about a transversely extending axis. This arrangement enables the new ties to be readily transferred.

In the illustrated embodiment, first work vehicle 41 of mobile apparatus 29 is coupled to the train of open top railroad cars 4 so that drive means 78 on the first work vehicle continuously advances the train of open top railroad cars of installation 1 and mobile apparatus 29 along railroad track 34. Coupling installation 1 for loading, transporting and unloading ties to mobile apparatus 29 for exchanging selected old ties for new ties has the advantage that the entire tie exchange operation may proceed continuously along railroad track 34 in an efficient manner while assuring an adequate supply of new ties and the removal of the old ties without interruption. This does away with the need for placing the ties along the track shoulders or on an adjacent track, which could interfere with train traffic thereover.

As shown in FIG. 6, vertically adjustable ballast broom 98 is arranged on the second work vehicle between a rear undercarriage thereof and a front undercarriage of third work vehicle 43.

In the illustrated combination of mobile tie loading, transporting and unloading installation 1 and mobile tie exchange apparatus 29, the mobile apparatus comprises lead work vehicle 32 preceding first work vehicle 41 in the operating direction. The lead work vehicle is equipped with automatic spike pulling device 30 followed by manually operable spike pulling device 31 for pulling any bent or otherwise damaged spikes which were not automatically pulled by device 30. Third work vehicle 43 succeeds second work vehicle 42 in the operating direction and comprises successive tie exchange operating devices 99, 100 displaceably mounted on the third work vehicle and respectively equipped for placing new tie plates on new ties 3 and for driving new rail fastening spikes into the new ties. The third work vehicle is coupled to the second work vehicle. Such a mobile apparatus provides all individual tie exchange operating devices for a complete tie exchange operation in an assembly-line fashion and is capable of operating with great efficiency. However, if required by specific operating conditions, the lead and third work vehicles may be used independently, particularly if the train of open top railroad cars is long, so as to avoid the use of an excessively long complete train of transport and work vehicles.

Self-propelled tie plate placing device 99 is substantially the same as tie plate detaching device 44 and has guide wheels 101 supporting the device on railroad track 34 and its own drive 103 to make device 99 self-propelled and self-propelled device 99 comprises drive 107 for the displacement of the device during a tie plate placing operation, and coupling 104 connects the device to work vehicle 43. The tie placing device also has carrier frame 102 supporting an operator's seat in the range of operating units 105 arranged adjacent the rails of the railroad track to enable an operator to actuate the operating units for slightly raising the rails for a moment and inserting the new tie plates between the new ties and the rails. Spike driving device 100 similarly has carrier frame 110 supporting an operator's seat in the range of vertically adjustable spike driving tools 112 arranged adjacent rails 51 of railroad track 34 to enable an operator to drive the spikes into the new ties. The spike driving device carrier frame has front and rear wheels 108 wherebetween spike driving tools 112 are mounted and which support the device on the railroad track, and the device is propelled by drive 109 and comprises a drive for the displacement of the device during a tie plate placing operation, and coupling 111 connects the device to machine frames 106 of work vehicle 43.

As can be seen in the top view of FIG. 7, old tie turning device 62 may be pivoted by drive 113 in the direction of the arcuate arrow shown in the drawing from a transverse position shown in chain-dotted lines into a position extending parallel to the operating direction and new tie turning device 69 may be pivoted by drive 116 in the direction of the arcuate arrow shown in the drawing from a position extending parallel to the operating direction (shown in chain-dotted lines) into a transverse position. The old ties 2 are transferred from vertical conveyor 58 to turning device 62 by a pair of transversely aligned tie transferring devices 114 consisting of hydraulic cylinders pivotal about a transverse axis and piston rods with hooks on the free ends thereof for engaging the longitudinal edges of the ties. The two carrier beams 115 of machine frame 49 of work vehicle 41 are sufficiently widened in the range of vertical tie conveyor 58 to enable the ties to be elevated on entrainment plates 60 while they rest thereon in their transverse position.

As shown in FIG. 8, four reciprocal tamping tools 96 per rail 51 are provided for tamping ballast under new ties 3 at the points of intersection between the ties and rails.

The enlarged view of FIG. 9 shows some structural details more clearly. This figure shows the widening of carrier beams 115 of first work vehicle machine frame 49 to enable the transversely positioned old ties 2 to be elevated without problems. New tie conveyor means 65 is mounted on carrier beam 115 at the right side of the drawing by means of braces 117. As shown new tie conveyor means 65 is arranged at a higher level than old tie conveyor means 64 mounted on the opposite carrier beam 115 by means of braces 120. In this manner, the old ties may be readily turned from their transverse position into a longitudinally extending position. The endless conveyor bands of the old and new tie conveyor means 64 and 65 are driven by respective drives 119 and 118. The T-shape of carrier beams 115 of the machine frames of the first and second work vehicles provides common longitudinal guide track 56 on which tie exchange operating devices 53 and 88 are respectively longitudinally displaceably mounted by their flanged guide rollers 56 and 91 respectively engaging the guide track.

The illustrated tie pulling device 53 comprises carrier frame 54 on which a hydraulically operated tie gripper is mounted for gripping a respective old tie 2 at an end thereof and pulling it laterally for removal from the track. The tie gripper comprises tie clamping jaws 121 mounted on the free end of the piston rod of hydraulic lifting cylinder 122 whose opposite end is pivoted to carrier frame 54 and which is linked to transversely extending hydraulic cylinder 123 for laterally displacing the lifting cylinder with the tie clamped thereto whereby the clamped tie may be pulled upon extension of cylinder 123 and inserted upon retraction of this cylinder. Rollers 124 laterally displaceably mount tie gripper 121, 122, 123 on carrier frame 54. After an old tie 2 has been pulled out in the direction indicated by arrow 125, hydraulic cylinders 122 and 123 are operated for slightly lifting the pulled tie and then placing it on rails 51 of the railroad track.

FIG. 10 shows one half of driven tie turning device 62 comprising cranked carrier arm 126 rotatably about vertical axis 63. When the carrier arm has been rotated into the illustrated position to extend in the longitudinal direction parallel to the railroad track, the rearmost endless conveyor conveyor band 66 of first tie conveyor means 64 will extend between the ends and over the crank portion of carrier arm 126. Upon operation of drive 113, one end of which is attached to the carrier arm and the other end of which is attached to machine frame 49 of the work vehicle, carrier arm 126 will be turned 90° from a transverse position into the illustrated position. The free end of carrier arm 126 facing first conveyor means 64 carries hydraulically operable lifting plate 128 for lifting and supporting an end of tie 2 so that it rests above endless conveyor band 66 upon vertical adjustment of the lifting plate when the carrier arm is turned so that the tie will be turned with the carrier arm on which it is supported. When the tie comes to rest above endless conveyor band 66, lifting plate 128 is automatically lowered into the position shown in chain-dotted lines so that tie 2 is supported on the endless conveyor band, and the conveyor band is driven to convey the tie to the adjacent conveyor band of first conveyor means 64. Turning device 62 is then turned again to repeat this operation for successively removed old ties 2. New tie turning device 69 has substantially the same structure.

FIG. 11 illustrates another embodiment of a mobile apparatus for sequentially exchanging selected consecutive groups of old ties for groups of new ties while retaining groups of old ties between the selected old ties for support of the mobile apparatus on railroad track 130, each group including at least one tie and up to four ties, for example. Mobile apparatus 129 comprises elongated bridge-like work vehicle 131 having two undercarriages supporting respective opposite ends of the work vehicle on the railroad track. The work vehicle is articulated centrally between its opposite ends and comprises two machine frame parts 133, 134 linked by pivot 132 whereby the machine frame parts of the work vehicle may be pivoted with respect to each other about a vertical axis. An additional undercarriage supports the machine frame parts at the pivot on railroad track 130. A succession of different individual devices are mounted on work vehicle 131 between the undercarriages and are operative to effectuate different sequential operations for exchanging the selected ties for the new ties. As seen in the operating direction of the mobile apparatus indicated by arrow 138, these devices include device 136 for removing loosened tie plates and device 139 for pulling the selected old ties mounted on front machine frame part 133. Tie plate removing device 136 is supported on railroad track 130 by wheels 135 and longitudinally displaceable with respect to the machine frame part by drive 137. Tie puller 139 is longitudinally displaceably suspended on front machine frame part 133 by guide rollers 141 engaging guide track 142, and longitudinal displacement drive 140 links the tie puller to the front machine frame part for displacement thereof in the operating direction. Vertical old tie conveyor 143 is also mounted on front machine frame part 133 for lifting the removed old ties and moving them to old tie turning device 144 which turns the transversely positioned old ties 90° for transfer to old tie conveyor means 154. Vertically adjustable ballast scarifier 145 is mounted on the rear end of front machine frame part 133 immediately behind the center undercarriage. Rear machine frame part 134 supports new tie turning device 147 receiving new ties from new tie conveyor means 155 and turning them 90° for transfer to vertical conveyor 146 which lowers the new ties to railroad track 130. The rear machine frame part also supports longitudinally displaceable tie inserting device 148 connected to longitudinal displacement drive 149 and longitudinally displaceable tamping unit 151 connected to longitudinal displacement drive 152 for tamping ballast under inserted new ties 150. Mobile apparatus 129 is self-propelled, for which purpose it carries power plant 156. The apparatus may be advanced continuously in the operating direction while respective ones of the tie exchange operating devices are longitudinally displaced with respect to the machine frame parts for a coordinated tie exchange operation. In effect, this apparatus operates equivalently to that described hereinabove in connection with FIGS. 5 and 6, except that the first and second work vehicles are combined into a single, two-part vehicle. Obviously, this apparatus may also be combined with the hereinabove-described mobile tie loading, transporting and unloading installation.

FIGS. 12 and 13 illustrate a modification of the rear portion of mobile apparatus 29 shown in FIG. 6. In this modified embodiment, tamping unit 89 at the rear end of second work vehicle 42 is replaced by tamping unit 157. Tamping tool carrier 158 of this tamping unit has a projecting centered pole and a free end of the pole is supported on centered guide 185 on machine frame 70 of second work vehicle 42 for displacement in the operating direction. The guide rollers are wheels 159 supporting the tamping unit on the railroad track and constituting an undercarriage guiding the tamping tool carrier at its front end along the railroad track. Drive 160 connects tamping tool carrier 158 to second work vehicle 42 for displacing the same relative thereto, and an operator's cab at the rear end of the second work vehicle is mounted within view of reciprocatory and vibratory tamping tools 162 of tamping head 161 for monitoring the operation thereof. Longitudinally displaceable tamping units of this type have proven to work very efficiently in a continuously proceeding tamping operation so that it is possible to operate effectively with a single tamping unit for tamping new ties inserted by two preceding tie inserters. Supporting one end of the tamping unit on the work vehicle by a centered pole while its other end is supported on the railroad track assures proper centering of the tamping tools over respective ones of the inserted ties.

As shown in the drawing, undercarriage 186 pivotally supports the rear end of second work vehicle 41 and a front end of third work vehicle 164. The two work vehicles are pivotal with respect to each other about vertical axis 187. Undercarriage 165 supports a rear end of work vehicle 164. A single tie exchange operating device 166 equipped for inserting tie plates is mounted on machine frame 163 of the third work vehicle between undercarriages 186 and 165. Tie plate inserting device 166 is self-propelled and has its own drive 167. It is longitudinally displaceable by drive 184 coupled to carrier frame 169 of the tie plate inserting device at 183, the carrier frame being supported on the railroad track by guide wheels 168 and carrying operating units 170 at a front end thereof for inserting the tie plates at each rail of the railroad track. Tie plate storage bin 171 is mounted on machine frame 163 of third work vehicle 164 adjacent the front end and above tie plate inserting units 170. Tie plate conveyor means 173 comprised of endless conveyor band 173 extends below operator's cab 174 for receiving tie plates from, or delivering tie plates to, storage bin 174 at one end thereof and having an opposite end at the rear end of the third work vehicle above rear undercarriage 165 for delivering tie plates to, or receiving tie plates from, further tie plate storage bin 175. Third work vehicle 164 is the last work vehicle of mobile apparatus 29 in the operating direction, and operator's cab 174 houses control and monitoring means 176 for a continuous operation of the apparatus. Pivotally linking the third work vehicle to the second work vehicle on a common undercarriage simplifies the structure and reduces construction costs. Also the storage and conveyance of the tie plates on the third work vehicle increases the efficiency of the operation. The operator's cab at the rear end of the mobile apparatus greatly enhances the control and monitoring of the tie exchange operation.

As shown in the drawing, open top storage car 177 follows third work vehicle 164 and is movable on the railroad track. Magnetic device 179 is mounted on the storage car for picking up detached tie plates from the shoulders of the railroad track and depositing the picked-up tie plates in the storage car. For this purpose, magnetic device 179 is affixed to a boom of crane 178 mounted on the storage car. Tie plate conveyor 180 extends between storage car 177 and third work vehicle 164 for conveying tie between the storage car and the third work vehicle, the tie plate conveyor having an end adjacent the opposite end of tie plate conveyor means 173 on the third work vehicle. This tie plate storage car enables the tie plates removed at the beginning of the tie exchange operation to be picked up and temporarily stored, and to be delivered again to the tie plate placing device after the new ties have been inserted.

FIG. 13 furthermore shows independent self-propelled machine 181 equipped for driving rail fastening spikes and capable of moving on the railroad track independently rearwardly of mobile apparatus 29. The independent machine is configurated to be borne on third work vehicle 164 in transit, i.e. it may be carried on platform 182 at the rear end of the third work vehicle when the apparatus is moved from one operating site to another. This further increases the overall efficiency of the tie exchange operation.

It is possible, of course, to mount additional, preferably longitudinally displaceable tie exchange operating devices on respective ones of the work vehicles in proper sequence, such as tie planing devices, old tie comminuting devices and new tie aligning devices.

FIGS. 14 to 20 illustrate another embodiment of a mobile installation 201 for loading, transporting and unloading such track parts as ties 202 on, in and from open top railroad cars 203, combined with mobile apparatus 233 for exchanging selected old ties for new ties. Mobile installation 201 comprises a train mounted for mobility in an operating direction indicated by arrow 244 along railroad track 207 consisting of rails 206 fastened to ties 205. Adjacent railroad cars 203 are coupled together and each car is supported by swivel trucks 204 on railroad track 207. The open top railroad cars have two parallel side walls with top edges 208 extending in the direction of the railroad track and two end walls 210 extending perpendicularly thereto. The end walls of adjacent railroad cars 203 define respective gaps 209 therebetween.

Track 211 supports undercarriages 219 of power-driven crane 212 for loading and unloading ties 202 for mobility in the direction of railroad track 207 above top edges 209 of railroad cars 203. This track comprises two parallel guide rails 213 mounted on top edges 208 and spaced apart a distance corresponding to the gage of crane undercarriages 219, the guide rails extending beyond end walls 210 of railroad cars 203 into gap 210 between the adjacent cars to provide a substantially continuous track 214 for support of the crane undercarriages along the train of cars. In this embodiment, the track guide rails are affixed directly to the top edges of the railroad cars by spot-welding at spot-welding points 215 spaced along the guide rails. Intermediate guide rail pieces 216 detachably connect guide rails 213 of the adjacent railroad cars in gaps 210 whereby the guide rails with the intermediate guide rail pieces form a continuous track 214 along the coupled railroad cars. Such a fixed fastening of the track guide rails directly on the top edges of the open top railroad cars provides a very secure and safe support for the heavy power-driven crane during its movement along the track while being quite cost-effective in retrofitting existing railroad cars with such a track. Gondola cars equipped with such permanently affixed guide rails may be used in standard freight operations since these guide rails in no way obstruct access to the cars through their open tops. Providing detachable connecting pieces 216 forms a continuous track for the crane along the entire train while the adjacent ends of the guide rails on adjacent cars will be far enough apart when the connecting pieces are detached so that they will not interfere with each other during standard operation of such freight cars. Thus, extending guide rails 213 beyond end walls 209 but short of the ends of the coupling buffers between the adjacent cars enables the cars to operate without any interference by the guide rails in standard freight operations while the intermediate connecting piece will provide a continuous track for the power-driven crane in the specialized operations herein disclosed.

As best shown in FIG. 20, intermediate guide rail piece 216 preferably comprises a welded unit of two parallel guide rails interconnected by transversely extending bracing rod 255. Rail webs 257 and rail bases 258 of the guide rails of the intermediate guide rail piece are recessed from rail heads 256 at the opposite ends of the guide rails and, correspondingly, the rail heads of guide rails 213 are recessed from the rail webs and bases thereof so that rail heads 256 of the intermediate guide rail piece overlap the rail webs of guide rails 213, thus interlocking the intermediate guide rail piece with track 214. To prevent any sideways movement therebetween, detachable connecting plates 259 are used to fasten the rail webs to each other. Attachment and detachment are thus very simple.

As illustrated in FIG. 14, power-driven crane 212 comprises pivotal overhead outrigger 217 and another outrigger 220 mounted for mobility on guide rails 213. The other outrigger carries endless conveyor 224 for receiving and storing ties 202. The mobile installation further comprises bridge-like gantry crane 226 mounted for mobility on guide rails 213 and this gantry crane includes means 227 for loading the ties on, and unloading the ties from, endless conveyor band 224. This combination of cranes 212 and 226 produces a very high efficiency in the loading, transporting and unloading of the ties with a minimum of uneconomical down-time. Mounting the endless tie conveyor band on the power-driven crane for the rapid conveyance of the ties assures that the conveyor band will always be at the same distance from the outrigger, regardless of the position of the crane with respect to the gondola car on which it moves. This distancing of the conveyor band from the outrigger, on the other hand, makes it possible to move the gantry crane without hindrance into a position to receive the ties from the endless conveyor.

An outer end of pivotal outrigger 217 carries tie gripping means 218 for hoisting bundles of ties 202 out of the open top railroad car and crane 212 is supported by undercarriages 219 on guide rails 213. Frame-shaped outrigger 220 has one end coupled to the crane so that this outrigger is moved along with the crane by drive 222. An opposite end of the frame-shaped outrigger is supported on the base of the guide rails by undercarriage 221. Endless conveyor 224 is mounted on an end of frame-shaped outrigger 220 remote from crane 212 for receiving ties 202 from pivotal outrigger 217 and for temporarily storing the ties. The endless conveyor band has drive 223 and a stop 225 at an end of the conveyor band remote from crane 212 for de-activating the drive. Conveyor band drive 223 is remote controllable from power-driven crane 212 by a crane operator in the cab of the crane. This enables the crane operator to drive the endless conveyor band after a suitable number of ties have been placed on one end of the conveyor band so that they are moved towards the remote end thereof.

When the leading tie has reached this end, the stop will de-activate the drive and further movement of the conveyor band will be halted.

A portion of frame-shaped outrigger 220 between power-driven crane 212 and endless conveyor band 224 defines a recess whose length in the operating direction exceeds that of ties 202 while the width of this outrigger is less than the gage of track 211. A recess of the indicated dimension will enable the ties to be lifted out of the open top railroad car and to be deposited thereinto without hindrance while an outrigger of the indicated width will permit gantry crane 226 to be moved over endless conveyor band 224 for loading and unloading the ties on, and from, the conveyor band.

Further structural details of mobile installation 201 are shown in FIGS. 16 to 18. The transverse section of FIG. 16 illustrates open top railroad car 203 comprised of two side walls 248 and two end walls 210 extending perpendicularly thereto. Bottom wall 249 interconnects the side and end walls to provide a loading and storage space for ties 202. Bases 250 of guide rails 213 are spot-welded to top edges 208 of the side walls at spot-welds 215. Recess 251 in frame-shaped outrigger 220 between endless conveyor band 224 and crane 212 is shown in the top view of FIG. 17. Pivotal outrigger 217 hoists ties 202 through recess 251 and places the hoisted ties on conveyor band 224, the tie gripper 218 on pivotal outrigger 217 being pivotal about a vertical axis so that it may turn the ties from their transverse into a longitudinal position as it grips the ties in the hold of the railroad car through recess 251 and then turn them back into their transverse position to lay them on the endless conveyor band in that position.

The fragmentary view of FIG. 18 shows a detail of tie loading and unloading means 227 on the gantry crane, which comprises gripping rails 232 transversely spaced apart a distance corresponding to the length of the ties and having a length corresponding to that of endless conveyor band 224, vertically adjustable carrier 253 for the gripping rails, and drive 254 for pivoting the gripping rails on the carrier about axis 252 extending in the operating direction. The two ends of carrier 253 are attached to winches 231 for vertically adjusting the loading and unloading means on the gantry crane. Gripping rails 232 have an L-shaped cross section, the horizontal leg of the gripping rails subtending the ends of ties 202 for gripping the ties when the gripping rails are in the position shown in full lines in FIG. 18 while the ties are released when the gripping rails are pivoted by drive 254 into the position shown in dash-dotted lines in this figure. The gantry crane carries an operator's cab 230 and has its own drive 229. The combination of the hereinabove described power-driven crane 212 and grantry crane 226 provides a very effective, secure and trouble-free system for loading, transporting and unloading such track parts as ties even when a relatively long train of open top railroad cars is used.

FIGS. 15 and 19 show the combination of mobile installation 201 with mobile apparatus 233 for sequentially exchanging selected consecutive groups of old ties for groups of new ties while retaining groups of old ties between the selected old ties for support of the mobile apparatus on railroad track 207, for example for exchanging groups of two or three old ties for new ties. This apparatus comprises a succession of elongated bridge-like work vehicles 234 each having two undercarriages supporting respective opposite ends of the work vehicle on the railroad track. As shown in FIGS. 14 and 15, the work vehicles are coupled to open top railroad cars 203 and a succession of different individual devices 237 are mounted respectively on the work vehicles between the undercarriages and operative to effectuate different sequential operations for exchanging the selected old ties for the new ties. Respective drives 236 connect tie exchange operating devices 237 to machine frame 235 of each work vehicle for displacing the devices with respect to the work vehicle in the operating direction along a displacement path. Mobile apparatus 233 further comprises two parallel guide rails 238 on top of machine frames 235 of the work vehicles and these guide rails are spaced apart a distance corresponding to the spacing of the two parallel guide rails 213 mounted on the top edges of open top railroad cars 203, guide rails 238 continuing track 211 supporting the undercarriages 219 of crane 212. As shown in FIG. 19, parallel ledges 239 extend on machine frame 235 between guide rails 238 for supporting ties 202. The illustrated undercarriages supporting the work vehicles on the railroad track are swivel trucks 240 and the work vehicles house power plants 241 to provide power to the various drives. Second work vehicle 234 carries conveyor means 242 for the old ties and conveyor means 243 for the new ties, which is spaced from conveyor means 242 and extends on a slightly higher level. In the operating direction indicated by arrow 244, leading tie exchange operating device 237 is a device 245 for pulling spikes and the second tie exchange operative device is a device 246 for removing tie plates. On the following work vehicle 234, first tie exchange operating device 237 is a device 247 for pulling old ties. Additional devices required for the tie exchange operation are mounted on this work vehicle and/or succeeding work vehicles, as needed, and the work vehicles may also mount means for receiving, turning and transferring the ties, as has been more fully described hereinabove.

The tie exchange operation effectuated by mobile installation 1 and mobile apparatus 29 can be understood from a consideration of the illustrated embodiments as described hereinabove and will now be explained in detail:

As soon as installation 1 and apparatus 29 have arrived at the operating site, devices 30 and 31 for pulling spikes are disengaged from couplings 35 suspending the devices on machine frame 36 of work vehicle 32 and are placed on railroad track 34. Operation of drives 78 and 79 causes the entire train of coupled gondola cars and work vehicles of installation 1 and apparatus 29 to be continuously advanced in the operating direction indicated by arrow 40. At the same time, individual tie exchange operating devices 30 and 31 are intermittently advanced with respect to the continuously moving work vehicle 32 from one old tie to be exchanged to the next old tie to be exchanged. Leading spike puller 30 is designed for automatically pulling the spikes. Any bent spikes which have not been gripped and pulled by automatic spike puller 30 are manually removed by trailing spike pulling device 31. The pulled spikes are placed next to the rails and are picked up by magnetic spike collector 33 which moves them into a storage bin, as indicated in dash-dotted lines. While the train advances continuously, new tie conveyor means 65 receives and conveys new ties 3 and old tie conveyor means 64 simultaneously receives and conveys old ties 2. These operations are aided by power-driven cranes 12 moving along track 11. While gripper 27 of leading crane 12 picks up old ties 2 conveyed by conveyor means 64 from trailing mobile apparatus 29 shown in FIG. 5 and places these old ties in the hold of leading open railroad car 4, trailing crane 12 hoists the new ties 3 stored in the trailing open railroad car and places them on new tie conveyor means 65. The cranes may be moved on continuous track 11 from car to car and, if desired, mobile installation may comprise more than two open top railroad cars and, depending on the length of the train of railroad cars, up to eight or ten cranes may be used. The ties are transferred from one to the next endless conveyor band 66 of conveyor means 64 and 65 during their conveyance. If, for some reason, the number of conveyed ties exceeds the operating capacity of leading crane 12, stop 24 is operated either by an operator or by engagement with the leading old tie to stop drive 20 of the endless conveyor band. As soon as the accumulation of old ties 2 at leading crane 12 has been placed in the railroad car, remote control 28 may be operated to activate conveyor band drive 20 and thereby to continue the conveyance of old ties to the crane. Since separate and independently operable conveyor means 64 and 65 are provided, the described operations for handling the old and new ties may be effected independently of each other and simultaneously.

While mobile installation 1 and apparatus 29 still advance continuously, device 44 for removing the tie plates and device 53 for withdrawing the old ties are intermittently moved with respect to continuously advancing work vehicle 41 whereon they are longitudinally displaceably mounted. As shown in chain-dotted lines in FIG. 5, device 44 has been moved over an old tie 188 for removing a tie plate positioned between this tie and rail 51, whereupon longitudinal displacement drive 50 is operated to advance the device to the next selected old tie, for example a distance of three ties, to remove the tie plate there. This intermittent operation is repeated during the entire continuous advance of mobile apparatus 29. Meanwhile, trailing device 53 has pulled the old tie 189 laterally out of the railroad track and placed it on railroad track rails 51, the spikes fastening the rails to this tie and the interposed tie plate having been previously removed by devices 30 or 31 and 44, respectively. Longitudinal displacement drive 57 is then operated to advance tie puller 53 along guide track 56 for placing the tie puller into registry with the next old tie to be withdrawn (see position shown in chain-dotted lines). A further, trailing tie puller 53 meanwhile pulls another old tie 190 and places it on the rails, whereupon it is moved forwardly into the position shown in chain-dotted lines. The ends of the old ties placed on rails 51 are engaged and lifted by lifting hooks 61 and raised on entrainment plates 60 of endless conveyor chain 59 of vertical conveyor 58. As soon as each old tie has reached the level of tie turning device 62, the revolution of the endless conveyor chain is discontinued and tie transfer device 114 is operated to push the old tie from the entrainment plate onto turning device 62 (see position of the turning device shown in chain-dotted lines in FIG. 9). The revolution of endless conveyor chain 59 is then resumed and drive 113 of turning device 62 is operated to turn the old tie 90° on carrier arm 126 so that its position is changed from one extending transversely to the operating direction to one extending parallel thereto, in which position it is conveyed on conveyor means 64. This is accomplished by lowering plate 128 (FIG. 10) to place the tie on endless conveyor band 66. The old tie conveyor means now conveys the old tie to crane 12 which places it in car 4.

The depression in the ballast resulting from the removal of the selected old tie is deepened by lowering tripartite drum 84 of ballast scarifier 81 onto the ballast bed and rotating the drum so that the teeth on the periphery of the drum bite into the ballast and increase the depression sufficiently to enable a new tie to be pushed into this dug-up space 193. Longitudinal displacement drive 83 moves the ballast scarifier relatively to continuously advancing work vehicle 41 while the ballast scarifier is in operation, i.e. the ballast scarifier remains in place during the continuous advance of the work vehicle.

Meanwhile, conveyor means 65 has continuously conveyed new ties 3 in a sense opposite to the operating direction to turning device 69. As described in connection with the turning of old ties 2, drive 116 is operated to turn the new ties by device 69 from a position parallel to the operating direction to a position extending transversely thereto. The transversely positioned new ties are transferred by device 191 onto endless conveyor band 73 whereon a number of the new ties are stored, and the new ties are transferred sequentially by device 74 from the rear end of the endless conveyor band to consecutive entrainment plates 86 of vertical conveyor 85. As soon as each new tie has reached the lower end of the vertical conveyor, it is transferred to lifting hooks 87 which place the new tie on rails 51 of railroad track 34. The movements of the respective tie exchange operating devices are so coordinated and synchronized that each new tie 192 is placed on the rails above a respective transverse ballast ditch 193 dug up by ballast scarifier 81. As soon as the continuous advance of mobile apparatus 29 has moved new tie inserter 88 into transverse alignment of new tie 192 placed on rails 51, an end of the new tie is gripped by device 121 of the tie inserter and the device is operated to insert the new tie under railroad track 34 into dug-up space 193. During the tie inserting operation, tie inserter 88 remains stationary with respect to railroad track 34 and moves relatively to continuously advancing machine frame 70 of work vehicle 42, as shown in chain-dotted lines in FIG. 6. After completion of the tie insertion operation, longitudinal displacement drive 92 is operated to advance tie inserter 88 rapidly into a position for effectuating the next tie insertion. Trailing tie inserter 88 is operated in tandem with the leading tie inserter in a like manner so that two new ties are inserted at the same time.

Tamping unit 89, which is supported by undercarriages 93 on railroad track 34, is now moved by longitudinal displacement drive 97 linking the tamping unit to machine frame 70 from a rear position shown in chain-dotted lines in FIG. 6 to a forward position illustrated in full lines. In this forward position, tamping tools 96 are centered over each newly inserted new tie and the centered tamping tools are immersed in the ballast, reciprocated and vibrated to tamp the ballast under the new tie. At the rear of work vehicle 42, ballast broom 98 is rotated to brush off ballast from both sides of the rails.

At the front of third work vehicle 43, device 99 is operated to place a tie plate between each rail 51 and the new tie while the rails are temporarily slightly raised to enable the tie plate to be inserted between the rail and the tie. Trailing device 100 is then operated to drive in the spikes to fastened the rails to the new tie. During their operation, tie exchange operating devices 99, 100 are longitudinally displaced with respect to machine frame 106 of the third work vehicle. With the work on work vehicle 43, the tie exchange operation is completed and railroad track 34 is ready for regular train traffic.

Longitudinal displacement drives 50, 57, 92, 97, 107, 160 and 184 of tie exchange operating devices 44, 53, 88, 99, 10, 157 and 166 have displacement paths x and/or guide tracks 56 on machine frames 49 and 70 have corresponding lengths y (FIG. 6) for the relative back-and-forth movement of the devices with respect to the continuous advancing movement of the mobile apparatus. If the apparatus is designed for the exchange of each third tie, x and y for each device are preferably a little longer than distance z between three ties.

In the modified embodiment of mobile apparatus 29 shown in FIG. 12, tamping tool carrier 158 with tamping head 161 is intermittently advanced while work vehicles 41, 42 and 164 move continuously (non-stop) in the operating direction for the exchange of groups of ties. Tamping unit 157 is very efficient and is, therefore, particularly useful in conjunction with multiple tie withdrawal devices 53 and tie inserting devices 88. After the ties have been tamped, tie plates are inserted by operating units 170 of tie exchange operating device 166 which is self-propelled and has its own drive 167 which is actuated intermittently by the operator to move from one newly inserted tie to the succeeding newly inserted tie while work vehicle 164 advances continuously. Alternately, tie exchange operating device 166 may be coupled at 183 to longitudinal displacement drive 184 replacing drive 167 for intermittently moving this device from tie to tie. The tie plates are manually removed from storage bin 171 to operating units 170 and the storage bin continuously receives tie plates from storage car 177 by conveyors 180 and 172. The tie plates are collected from the track shoulder and placed into storage car 177 by laterally pivotal crane 178 and magnetic pick-up device 179.

In the operation of mobile installation 201 and mobile apparatus 233 shown in FIGS. 14 and 15, a few cars 203 are filled with new ties 202 according to need before the tie exchange operation. A few empty cars 203 are coupled to installation 201 to receive old ties. After the working site has been reached, intermediate guide rail pieces 216 are placed in position to connect the ends of guide rails 213 projecting beyond end walls 210 of adjacent railroad cars 203 so that continuous track 214 extends along the entire length of the train of cars 203 and work vehicles 234. The intermediate guide rail pieces shown in FIG. 14 are designed for substantially straight track sections. If the apparatus operates in curves, differently shaped intermediate guide rail pieces will be used for establishing the continuous track atop the train. The train comprised of installation 201 and apparatus 233 is then continuously advanced in the direction of arrow 144. The tie exchange is effected in the above-indicated manner by tie exchange operating device 237. First, device 245 is operated to pull the spikes of, for example, every third or fourth tie of the existing track and device 246 is then operated to remove the tie plates from these ties. Old ties 205 thus detached from the rails are then withdrawn laterally from track 207 by device 247 and laid on the track. The old ties laid on the track are then received by a tie lifting device and placed on conveyor 242 for the old ties. The new ties conveyed by conveyor 243 are then inserted in the areas vacated by the old ties, the tie plates are placed in position and the rails are again fastened to the newly inserted ties, all as described hereinabove in connection with the other embodiments. Longitudinal displacement drives 236 intermittently displace tie exchange operating devices 237 relative to work vehicles 234 so that the operating devices will remain stationary for short working periods while the apparatus advances continuously.

Largely independently of this tie exchange operation, the old and new ties are transported unhindered by this operation along continuous guide track 214. To supply new ties 202, pivotal overhead outrigger 217 of power-driven crane 212 is lowered through recess 251 of frame-shaped outrigger 220 and gripping means 218 is operated to seize a bundle of, for example, four ties. Outrigger 217 is then raised and the bundle of ties is laid on conveyor band 224. While the next bundle of ties is raised, the operator on crane 212 actuates drive 223 by remote control so that the bundle of ties on conveyor band 224 is transported in the direction of stop 225 and room is made available on the conveyor band for the next bundle of ties. As soon as longitudinally extending conveyor band 224 is fully loaded with new ties 202, the operator in cab 230 on gantry crane 226 moves the gantry crane along guide track 214 over conveyor band 224 (see chain-dotted lines in FIG. 14). Winches 227 are then operated to lower hoist 227 and to pivot gripping rails 232 outwardly (see chain-dotted lines in FIG. 15). The gripping rails are then inwardly pivoted to subtend the end of ties 202 on conveyor band 224 whereby the ties are gripped and winches 227 are operated again to raise the gripped ties, whereupon gantry crane 226 is moved back along guide track 214 over railroad car 203 to work vehicle 234 where the new ties are laid on support ledges 239 (FIGS. 15 and 19). Meanwhile, old ties 260 collected on conveyor band 242 are picked up by another gantry crane 226 and are placed on a free section of tie support ledges 239. The old ties are then picked up by the gantry crane which transported the new ties, and this gantry crane is moved over railroad car 203 where gripping rails 232 are operated to release the old ties and to load them into car 203. The gantry crane is then moved forward over conveyor band 224 which meanwhile has been loaded with new ties, and this operation is repeated.

When gripping means 218 can no longer pick up new ties 202 because no new ties are within reach of pivotal outrigger 217, power-driven crane 212 is moved on its undercarriages 219 along guide track 214, which causes outrigger 220 and its conveyor band 224 supported by wheels 221 on the base of guide rails 213 to be moved along with the crane. Since wheels 221 are supported on the base of the guide rails, gantry crane 226 may move on guide rails 213 over conveyor band 224 without hindrance. For more secure guidance, the wheels of undercarriages 219 and 228 may be double-flanged wheels.

Within the scope of the present invention, various modifications may occur to those skilled in the art. For example, open top railroad cars useful for the transport not only of ties but of other goods, such as various track components, may be used only for transporting old ties previously removed in an independent operation. Thus, the mobile loading, transporting and unloading installation may be used independently of the mobile tie exchange apparatus, for instance by simply placing the new ties next to the railroad track and receiving and transporting the old ties later. The number of cranes moving atop the open railroad cars and of the conveyor units may vary widely, depending on the capacity of the railroad cars. Also, different types of conveyors, including roller conveyors instead of endless conveyor bands, may be used, particuarly for handling such heavy goods as concrete ties. Obviously, the number of tie exchange operating devices may also vary widely and additional ones of such devices may be used, depending on the applied tie exchange technology, such as a tie saw device preceding the tie withdrawing device so that the ties may be sawn into pieces before they are withdrawn from the railroad track, and/or a device for applying rail anchors succeeding the tie insertion device. Obviously, the devices for detaching the rails from the ties and fastening them thereto will depend on the nature of the rail fastening elements used. Depending on the rhythm of the operation, in which the continuous advance is coordinated with the cyclical tie exchange, a series of the same tie exchange operating devices may be used instead of a single such device. Also, instead of using guide rollers running on guide tracks for longitudinally displaceably suspending the tie exchange operating devices, other such displacement means may be used, including parallelogram linkages, sprocket chains and like mechanisms. Under difficult operating conditions, the mobile tie exchange apparatus may remain stationary during a tie exchange and may be advanced intermittently until conditions improve and the apparatus can be moved continuously again.

What is claimed is:

1. A mobile apparatus for sequentially exchanging selected consecutive groups of old ties for groups of new ties in an existing railroad track comprising two rails fastened to consecutively arranged ties while retaining the rails and groups of old ties fastened thereto between the selected groups of new ties for support of the mobile apparatus on the existing railroad track, which comprises (a) at least one elongated bridge-like work vehicle having two undercarriages supporting respective opposite ends of the work vehicle on the existing railroad track, (b) a succession of individual devices displaceable in the direction of the railroad track and operative to effectuate different successive operations for exchanging the old ties for the new ties, the devices including (1) at least two tie pulling and inserting devices for respectively pulling the old ties laterally out of, and inserting the new ties laterally into, the track, and the tie pulling and inserting devices being mounted on a respective work vehicle between the undercarriages, (c) respective drives for displacing the individual tie pulling and inserting devices with respect to the work vehicle in the direction of the railroad track along a displacement path, and (d) drive means for continuously advancing the mobile apparatus in said direction, (1) the displacement path of the individual tie pulling and inserting devices permitting relative movement between the devices and the work vehicle to hold the devices in place while the mobile apparatus continuously advances, in combination with a mobile installation for loading, transporting and unloading the ties on, in and from open top railroad cars, which installation comprises (e) a train mounted for mobility along the railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (f) a power-driven crane for loading and unloading the track parts and having an undercarriage supporting the crane for mobility in the direction of the railroad track, and (g) a track supporting the undercarriage of the crane for mobility above the top edges of the railroad cars in said direction, the track comprising (1) two parallel guide rails mounted on the top edges of the railroad cars and being spaced apart a distance corresponding to the gage of the crane undercarriage, the guide rails extending beyond the end walls of the railroad cars into the gaps between the adjacent cars to provide a substantially continuous track for support of the crane undercarriage along the train of cars, and the mobile tie exchange apparatus further comprising (h) two parallel guide rails mounted on top of the work vehicle and being spaced apart a distance corresponding to the spacing of the two parallel guide rails mounted on the top edges of the open top railroad cars, the two parallel guide rails on top of the work vehicle continuing the track supporting the undercarriage of the crane.

2. A mobile apparatus for sequentially exchanging selected consecutive groups of old ties for groups of new ties in an existing railroad track comprising two rails fastened to consecutively arranged ties while retaining the rails and groups of old ties fastened thereto between the selected groups of new ties for support of the mobile apparatus on the existing railroad track, which comprises (a) at least one elongated bridge-like work vehicle having two undercarriages supporting respective opposite ends of the work vehicle on the existing railroad track, (b) a succession of individual devices displaceable in the direction of the railroad track and operative to effectuate different successive operations for exchanging the old ties for the new ties, the tie exchanging devices including (1) at least two tie pulling and inserting devices for respectively pulling the old ties laterally out of, and inserting the new ties laterally into, the track, and the tie pulling and inserting devices being mounted on a respective work vehicle between the undercarriages, (c) respective drives for displacing the individual tie pulling and inserting devices with respect to the work vehicle in the direction of the railroad track along a displacement path, and (d) drive means for continuously advancing the mobile apparatus in said direction, (1) the displacement path of the tie pulling and inserting devices permitting relative movement between the devices and the work vehicle to hold the devices in place while the mobile apparatus continuously advances, (e) a tie conveyor associated with each tie pulling and inserting device and having a lower and an upper end, the lower conveyor end being arranged respectively to receive an old tie from the associated device and to deliver a new tie to the associated device, and (f) a tie conveyor means having an end adjacent the upper tie conveyor end respectively to receive an old tie from the upper tie conveyor end and to deliver a new tie to the upper tie conveyor end, (1) the tie conveyor and tie conveyor means being mounted on the work vehicle and being arranged to receive, convey and deliver the ties oriented transversely to the track.

3. A mobile apparatus for sequentially exchanging selected consecutive groups of old ties for groups of new ties in an existing railroad track comprising two rails fastened to consecutively arranged ties while retaining the rails and groups of old ties fastened thereto between the selected groups of new ties for support of the mobile apparatus on the existing railroad track, which comprises:

(a) a succession of elongated bridge-like work vehicles having two undercarriages supporting respective opposite ends of the work vehicle on the existing railroad track, (b) a succession of different individual devices mounted on respective ones of the work vehicles between the undercarriages and operative to effectuate different successive operations for exchanging the old ties for the new ties, and (c) respective drives for displacing the individual tie exchange operating devices with respect to the work vehicles whereon they are mounted in the direction of the railroad track, (1) a first one of the work vehicles in an operating direction of the mobile apparatus comprising one of said individual tie exchange operating devices equipped for detaching old tie plates, said tie plate detaching device having guide wheels supporting the device on the railroad track, two of said individual tie exchange operating devices equipped to withdraw respective ones of said old ties laterally from the railroad track and to place the old ties on the railroad track, the individual tie withdrawing and placing devices having guide rollers suspending the devices on a guide track on the first work vehicle, the individual devices being spaced from each other in said direction on the first work vehicle, a vertical conveyor fixedly mounted on the first work vehicle rearwardly of the displaceable devices for vertically conveying the old ties placed on the railroad track, and a ballast scarifier mounted rearwardly of a rear one of the undercarriage on the first work vehicle, the ballast scarifier having wheels supporting the scarifier on the railroad track, and (2) a second one of the work vehicles succeeding the first work vehicle in the operating direction comprising a vertical conveyor fixedly mounted on the second work vehicle rearwardly of a front one of the undercarriages for vertically conveying the new ties to the railroad track, two of said individual tie exchange operating devices equipped to insert respective ones of said new ties laterally into the railroad track, the individual devices having guide rollers suspending the devices on a guide track on the second work vehicle, the individual devices being spaced from the vertical tie conveyor and each other in said direction on the second work vehicle, and a tamping unit for tamping ballast under the inserted new ties, the tamping unit having a tamping tool carrier with guide rollers displaceably supporting the tamping unit.

4. The mobile apparatus of claim 2, comprising a succession of said work vehicles mounting respective ones of said individual tie pulling and inserting devices.

5. The mobile apparatus of claim 2, wherein the length of the displacement path slightly exceeds the sum of the distances between three ties if groups of three ties are to be exchanged.

6. The mobile apparatus of claim 2, wherein the individual tie pulling and inserting devices have guide rollers supporting the devices for displacement.

7. The mobile apparatus of claim 6, wherein said guide rollers are wheels supporting at least one of the individual tie exchange operating devices on the railroad track, the one individual device being self-propelled.

8. The mobile apparatus of claim 7, wherein the self-propelled individual device comprises a drive for the displacement of the device during a tie exchange operation, and a coupling connecting the device to the work vehicle.

9. The mobile apparatus of claim 6, wherein said work vehicle further comprises a common guide track for the displacement of a plurality of said individual tie exchange operating devices, and the guide rollers of said plurality of individual devices engage the common guide track.

10. The mobile apparatus of claim 2, wherein the lower vertical tie conveyor end is substantially at the lever of the railroad track and the upper end is at a top of the work vehicle, and tie conveyor means is on the top of the work vehicle for conveying the ties between one of the ends thereof and the upper vertical tie conveyor end.

11. The mobile apparatus of claim 3, comprising a lead one of said work vehicles preceding the first work vehicle in the operating direction, the lead work vehicle comprising at least one of said individual tie exchange operating devices equipped for pulling old rail fastening spikes, and a third work vehicle succeeding the second work vehicle in the operating direction and comprising successive ones of said individual tie exchange operating devices displaceably mounted on the third work vehicle and respectively equipped for placing new tie plates on the new ties and for driving new rail fastening spikes into the new ties.

12. The mobile apparatus of claim 11, wherein the lead work vehicle comprises two of the individual tie exchange operating devices spaced apart in the operating direction, the devices being displaceably mounted on the lead work vehicle, and a front one of said devices being equipped for automatically pulling the rail fastening spikes while a rear one of the devices is equipped for manually pulling the spikes.

13. The mobile apparatus of claim 11, in combination with a mobile installation for loading, transporting and unloading the ties on, in and from open top railroad cars, which installation comprises (a) a train mounted for mobility along the railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (b) a power-driven crane for loading and unloading the track parts and having an undercarriage supporting the crane for mobility in the direction of the railroad track, and (c) a track supporting the undercarriage of the crane for mobility above the top edges of the railroad cars in said direction, the track comprising (1) two parallel guide rails mounted on the top edges of the railroad cars and being spaced apart a distance corresponding to the gage of the crane undercarriage, the guide rails extending beyond the end walls of the railroad cars into the gaps between the adjacent cars to provide a substantially continuous track for support of the crane undercarriage along the train of cars, and the mobile tie exchange apparatus further comprising (d) two parallel guide rails mounted on top of the work vehicle and being spaced apart a distance corresponding to the spacing of the two parallel guide rails mounted on the top edges of the open top railroad cars, the two parallel guide rails on top of the work vehicle continuing the track supporting the undercarriage of the crane, and wherein (e) the lead work vehicle precedes the open top railroad cars and is coupled thereto, the lead work vehicle comprising drive means for continuously advancing the open top railroad cars and the work vehicles along the railroad track.

14. The mobile apparatus of claim 11, further comprising a ballast broom arranged between a rear one of the undercarriages of the second work vehicle and a front one of the undercarriages of the third work vehicle.

15. The mobile apparatus of claim 3, wherein the first work vehicle further comprises first conveyor means for receiving successive ones of longitudinally aligned old ties and conveying the same away from the vertical conveyor and second conveyor means for conveying successive ones of longitudinally aligned new ties, the first and second tie conveyor means being mounted on top of the first work vehicle.

16. The mobile installation of claim 15, in combination with a mobile installation for loading, transporting and unloading the ties on, in and from open top railroad cars, which installation comprises (a) a train mounted for mobility along the railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (b) a power-driven crane for loading and unloading the track parts and having an undercarriage supporting the crane for mobility in the direction of the railroad track, and (c) a track supporting the undercarriage of the crane for mobility above the top edges of the railroad cars in said direction, the track comprising (1) two parallel guide rails mounted on the top edges of the railroad cars and being spaced apart a distance corresponding to the gage of the crane undercarriage, the guide rails extending beyond the end walls of the railroad cars into the gaps between the adjacent cars to provide a substantially continuous track for support of the crane undercarriage along the train of cars, and the mobile tie exchange apparatus further comprising (d) two parallel guide rails mounted on top of the work vehicle and being spaced apart a distance corresponding to the spacing of the two parallel guide rails mounted on the top edges of the open top railroad cars, the two parallel guide rails on top of the work vehicle continuing the track supporting the undercarriage of the crane, and wherein (e) each one of the conveyor means is comprised of a succession of conveyor means sections each consisting of a driven endless conveyor band, a respective one of the conveyor means being mounted at a respective side of the first work vehicle, and the first work vehicle further comprises two parallel guide rails mounted on top of the first work vehicle between the conveyor means, the guide rails being spaced apart a distance corresponding to the spacing of the two parallel guide rails mounted on the top edges of the open top railroad cars, the two parallel guide rails on top of the work vehicle continuing the track supporting the undercarriage of the crane.

17. The mobile apparatus of claim 15, wherein the first work vehicle further comprises a driven tie turning device arranged between the vertical tie conveyor and the first tie conveyor means for receiving the old ties from the vertical tie conveyor and turning them 90° for longitudinal alignment of the successive old ties.

18. The mobile apparatus of claim 17, wherein the first tie conveyor means has a discharge end disposed at the same level as the second tie conveyor means and continues from the discharge end to the tie turning device at a lower level than the second tie conveyor means, the lower level of the first tie conveyor means being spaced from the level of the second tie conveyor means by a distance corresponding at least to the height of the ties whereby the ties may be freely turned by the turning device without interference by the second tie conveyor means.

19. The mobile apparatus of claim 15, wherein the first work vehicle further comprises a driven tie turning device arranged at one of the ends of the first work vehicle for receiving the longitudinally aligned new ties from a discharge end of the second tie conveyor means and turning them 90°.

20. The mobile apparatus of claim 19, wherein the second work vehicle comprises a driven endless conveyor band arranged to receive the turned new ties from the tie turning device and conveying the turned new ties to a discharge end, and a tie transferring device on the second work vehicle for transferring the turned new ties from the discharge end of the endless conveyor band to the vertical tie conveyor on the second work vehicle.

21. The mobile apparatus of claim 3, wherein the first and second work vehicles are coupled to each other at facing ones of the ends thereof, an operator's cab is mounted on the end of the second work vehicle facing the end of the first work vehicle, the facing work vehicle ends support a power plant for the installation, the work vehicles have drives for continuously advancing the work vehicles, and the operator's cab comprises control and monitoring means for the individual tie exchange operating devices and drives.

22. The mobile apparatus of claim 3, wherein the first work vehicle is coupled to a train of open top railroad cars, and further comprising drive means on the first work vehicle for continuously advancing the train of open top railroad cars and the mobile apparatus along the railroad track.

23. The mobile apparatus of claim 3, wherein the tamping tool carrier of the tamping unit has a projecting centered pole, a free end of the pole being supported on the second work vehicle for displacement in said direction and the guide rollers being wheels supporting the tamping unit on the railroad track, and further comprising a drive connecting the tamping tool carrier to the second work vehicle for displacing the same relative thereto, and an operator's cab at a rear one of the second work vehicle ends and within view of the tamping unit for monitoring the operation thereof.

24. The mobile apparatus of claim 3, wherein one of the undercarriages of the second work vehicle pivotally supports a rear one of the second work vehicle ends, and further comprising a third work vehicle having a front end pivotally supported on the one undercarriage and a rear end supported on a rear one of the undercarriages, a single one of the individual tie exchange operating devices equipped for inserting tie plates being mounted on the third work vehicle, the single device being self-propelled for displacement relative to the third work vehicle between the undercarriages thereof and being supported by guide wheels on the railroad track, a tie plate storage bin mounted adjacent the front end, and a tie plate conveyor means receiving tie plates from, or delivering tie plates to, the storage bin at one end thereof and having an opposite end at the rear end of the third work vehicle above the rear undercarriage.

25. The mobile apparatus of claim 24, wherein the third work vehicle is the last work vehicle of the mobile apparatus in the operating direction, and further comprising an operator's cab mounted on the rear end of the third work vehicle and housing control and monitoring means for a continuous operation.

26. The mobile apparatus of claim 24, further comprising an open top storage car movable on the railroad track and following the third work vehicle, and a magnetic device mounted on the storage car for picking up detached tie plates from the shoulders of the railroad track and depositing the picked-up tie plates in the storage car.

27. The mobile apparatus of claim 26, further comprising a tie plate conveyor between the storage car and the third work vehicle, the tie plate conveyor having an end adjacent the opposite end of the tie plate conveyor means on the third work vehicle.

28. The mobile apparatus of claim 24, further comprising an independent self-propelled machine equipped for driving rail fastening spikes and capable of moving on the railroad track independently rearwardly of the mobile apparatus, the independent machine being configurated to be borne on the third work vehicle in transit.

* * * * *